US011015884B2

(12) United States Patent
Drake et al.

(10) Patent No.: US 11,015,884 B2
(45) Date of Patent: May 25, 2021

(54) CHASSIS OF SEMIAUTOMATIC RIFLES

(71) Applicant: Drake Associates, Inc., Vero Beach, FL (US)

(72) Inventors: Christopher Drake, Vero Beach, FL (US); Leslie C. Blahut, Vero Beach, FL (US)

(73) Assignee: Drake Associates, Inc., Vero Beach, FL (US)

( * ) Notice: Subject to any disclaimer, the term of this patent is extended or adjusted under 35 U.S.C. 154(b) by 0 days.

(21) Appl. No.: 16/844,650

(22) Filed: Apr. 9, 2020

(65) Prior Publication Data

US 2020/0284535 A1 Sep. 10, 2020

Related U.S. Application Data

(63) Continuation-in-part of application No. 16/272,836, filed on Feb. 11, 2019, now Pat. No. 10,739,107, which is a continuation-in-part of application No. 15/873,468, filed on Jan. 17, 2018, now Pat. No. 10,203,178.

(60) Provisional application No. 62/739,673, filed on Oct. 1, 2018, provisional application No. 62/446,898, filed on Jan. 17, 2017.

(51) Int. Cl.

| | |
|---|---|
| ***F41A 3/66*** | (2006.01) |
| ***F41A 21/48*** | (2006.01) |
| ***F41C 23/16*** | (2006.01) |

(52) U.S. Cl.

CPC ..... *F41A 3/66* (2013.01); *F41A 21/48* (2013.01); *F41C 23/16* (2013.01)

(58) Field of Classification Search

CPC ..... F41A 3/66; F41C 23/16

USPC ..... 42/72, 71.01

See application file for complete search history.

(56) References Cited

U.S. PATENT DOCUMENTS

| | | | | |
|---|---|---|---|---|
| 2,339,331 | A | 1/1944 | Grigg | |
| 3,011,283 | A | 12/1961 | Lunn | |
| 5,711,102 | A | 1/1998 | Plaster et al. | |
| 5,873,189 | A | 2/1999 | Menke | |
| 6,839,998 | B1 | 1/2005 | Armstrong | |
| 7,802,392 | B2 * | 9/2010 | Peterson | F41A 11/02 42/75.03 |
| 7,926,217 | B2 | 4/2011 | McCann | |
| 8,234,808 | B2 | 8/2012 | Lewis et al. | |
| 9,429,375 | B2 * | 8/2016 | DeSomma | F41A 3/66 |
| 9,534,859 | B2 | 1/2017 | Battaglia et al. | |
| 9,568,261 | B1 * | 2/2017 | Hall | F41A 3/66 |

(Continued)

OTHER PUBLICATIONS https://geissele.com/super-modular-rail-mk8-m-lokr.html; retrieved Feb. 12, 2020.

(Continued)

*Primary Examiner* — Reginald S Tillman, Jr.

(74) *Attorney, Agent, or Firm* — Carter, DeLuca & Farrell LLP

(57) ABSTRACT

A firearm includes a lower receiver defining a trigger well configured to receive an action, a lower forend extending distally from and monolithically formed with the lower receiver, and an upper forend detachably coupled to the lower forend. The lower forend and the upper forend together define a channel therethrough configured for receipt of a barrel of the firearm. The lower receiver is configured to support the barrel with the length of the barrel free-floating within the channel.

17 Claims, 28 Drawing Sheets

(56) References Cited

U.S. PATENT DOCUMENTS

| | | | | |
|---|---|---|---|---|
| 10,203,178 | B2 | 2/2019 | Drake | |
| 10,222,149 | B2 * | 3/2019 | Daley, Jr. | F41A 3/66 |
| 10,859,332 | B2 * | 12/2020 | McMillan | F41A 3/66 |
| 2007/0180750 | A1 | 8/2007 | Al-Mulla | |
| 2008/0244951 | A1 | 10/2008 | Picard | |
| 2010/0162608 | A1 | 7/2010 | McCann | |
| 2011/0283582 | A1 | 11/2011 | Hunter et al. | |
| 2015/0192384 | A1 * | 7/2015 | Ballard | F41A 9/70 42/49.01 |
| 2016/0178309 | A1 | 6/2016 | Drake | |
| 2016/0313087 | A1 | 10/2016 | Leasure | |
| 2017/0219310 | A1 | 8/2017 | Jones | |

OTHER PUBLICATIONS

Canadian Office Action issued in corresponding Application No. 3,071,914 dated Jun. 19, 2020.

* cited by examiner

CHASSIS OF SEMIAUTOMATIC RIFLES

CROSS-REFERENCE TO RELATED APPLICATIONS

This application is a continuation-in-part of U.S. patent application Ser. No. 16/272,836, filed on Feb. 11, 2019, which claims the benefit of, and priority to, U.S. Provisional Patent Application No. 62/739,673, filed Oct. 1, 2018.

U.S. patent application Ser. No. 16/272,836 is also a continuation-in-part of U.S. patent application Ser. No. 15/873,468, filed Jan. 17, 2018, now U.S. Pat. No. 10,203,178, which claims the benefit of, and priority to, U.S. Provisional Patent Application No. 62/446,898, filed Jan. 17, 2017. The entire contents of each of the above applications are incorporated by reference herein.

BACKGROUND

1. Technical Field

The present disclosure relates to firearms and, more specifically, to a chassis of a semiautomatic rifle (e.g., AR-10 and AR-15 style rifles including clones and hybrids thereof).

2. Discussion of Related Art

Modular rifle systems allow manufacturers to produce standard components of a rifle that allow dealers and end users to customize the rifle system. The major components of a modular rifle system are a stock, a chassis, a barrel, and an action. The chassis is the central component of the modular rifle system and may be integrally formed with the stock. The barrel and action each mount to the chassis.

SUMMARY

In an aspect of the present disclosure, the present disclosure relates to firearms and more specifically, to a tactical firearm system that is monolithically formed from the forearm to the stock mount, with a completely free floating upper receiver system for the utmost precision which allows for integration of modular weight systems. In embodiments, the adjustable system allows the user to customize the center of gravity of the rifle to maximize balance and performance as well as diminishing the effects of recoil. Specifically, unlike typical ARs which have handguards mounted directly to the barrel nut, a firearm of the present disclosure includes a lower receiver and handguard which can be milled from a single block of material (e.g. an aluminum billet). Accordingly, this monolithic design allows the entire barrel, including the barrel nut, to be free-floated for improved accuracy. Furthermore, the firearm technology/chassis system from bolt action performance of the present disclosure can be applied to a semi-automatic.

In aspects, the present disclosure relates to a firearm including a chassis having an adjustable precision rifle stock. The stock may allow for complete large and fine adjustments for fine tuning the stock to the shooter. In embodiments, the stock does not include wheels or knobs that are common to adjustable stocks that may get snagged or loosen during use. In embodiments, the firearm system may include a rail (e.g., ARCA rail) that runs the entire length of the forend with mounting points for additional rails, and accessories such as barricade stops or weight accessories. Weights may be mounted internally for a slick appearance, externally, or both externally and internally.

In aspects, the present disclosure relates to a firearm system with a toolless forend design where the forend locks in without a tool. The upper handguard also fastens to the lower handguard, not the upper receiver. In embodiments, this may provide a much more solid and tight seating for the upper receiver, while still utilizing the two standard receiver pins of an AR system. Accordingly, the vented upper section of the handguard is a modular piece that can be easily removed without the need for tools.

In further aspects, a firearm may include top-mounted Picatinny optics M-LOK accessory slots. Other accuracy enhancing features of the present disclosure may include an 11-degree target crown and a 2-stage competition trigger.

In aspects, a firearm chassis includes a lower receiver defining a trigger well configured to receive an action, a lower forend monolithically formed with the lower receiver and extending distally from the lower receiver, and an upper forend configured to slidably connect to the lower forend in a direction parallel to the lower forend. The lower forend defines a channel along a length thereof configured to receive a barrel. The lower receiver is configured support at least a majority of a weight of the barrel.

In aspects, the lower receiver may be configured to support an entirety of the weight of the barrel.

In aspects, the lower forend and the upper forend may be dimensioned to encapsulate the barrel and be spaced from the barrel along an entire length of the barrel.

In other aspects, the lower receiver may support the barrel thereon at a location proximal of a barrel nut of the barrel.

In more aspects, the lower forend may have a U-shaped transverse cross-sectional configuration.

In other aspects, the firearm chassis may include at least one weight disposed within the lower forend. The weight may be configured to move between at least two different locations along a length of the lower forend to adjust a center of mass of the chassis.

In aspects, the firearm chassis may include a fastening assembly configured to secure the lower forend and the upper forend to each other.

In further aspects, the fastening assembly may include a pin movably connected to the lower forend. The pin may be configured to engage the upper forend to selectively fix the upper forend to the lower forend.

In more aspects, the firearm chassis may include a biasing member configured to resiliently bias the pin into engagement with an opening defined in the upper forend.

In other aspects, the lower receiver may define a recess in a bottom surface thereof configured to receive a finger of a user. The recess may be disposed distally of the magazine well.

In aspects, the lower receiver may include a stock mount extending upwardly therefrom. The stock mount may define an opening that extends in a direction parallel with a longitudinal axis defined by the lower forend.

In accordance with another aspect, the present disclosure provides a firearm system that includes a chassis, an action, and a barrel. The chassis has an elongated lower receiver defining a trigger well, and an elongated lower forend extending distally from the lower receiver. The lower forend defines a longitudinally-extending channel. The action is configured to be received within the trigger well. The barrel is configured to be received within the channel and supported by the lower receiver.

In aspects, the lower forend and the lower receiver of the firearm system may be monolithically formed.

In some aspects, the firearm system may further include an elongated upper forend configured to detachably connect to the lower forend. The upper forend and the lower forend may cooperatively define an enclosed, elongated channel dimensioned for receipt of the barrel.

In other aspects the lower forend and the upper forend of the firearm system may be configured to be spaced from the barrel along an entire length of the barrel.

In aspects, the lower receiver may support the barrel thereon at a location proximal of a barrel nut of the barrel, such that at least a majority of a weight of the barrel is supported by the lower receiver.

In the aspects, the firearm system may further include an upper receiver and a pair of first and second fasteners. The upper receiver may be configured to couple to the lower receiver and has a pair of proximal and distal tabs. Each of the tabs may define a vertically-oriented hole and the lower receiver may define a pair of vertically-oriented holes. The first and second fasteners may be configured for receipt in the corresponding holes of the upper receiver and the lower receiver to selectively secure the upper receiver to the lower receiver.

In aspects, the firearm system may further include first and second dowels. Each of the proximal and distal tabs of the upper receiver may further define a horizontally-oriented hole configured for receipt of the corresponding first and second dowels.

BRIEF DESCRIPTION OF THE DRAWINGS

Various aspects of the present disclosure are described hereinbelow with reference to the drawings, which are incorporated in and constitute a part of this specification, wherein.

DETAILED DESCRIPTION

Figure 1:
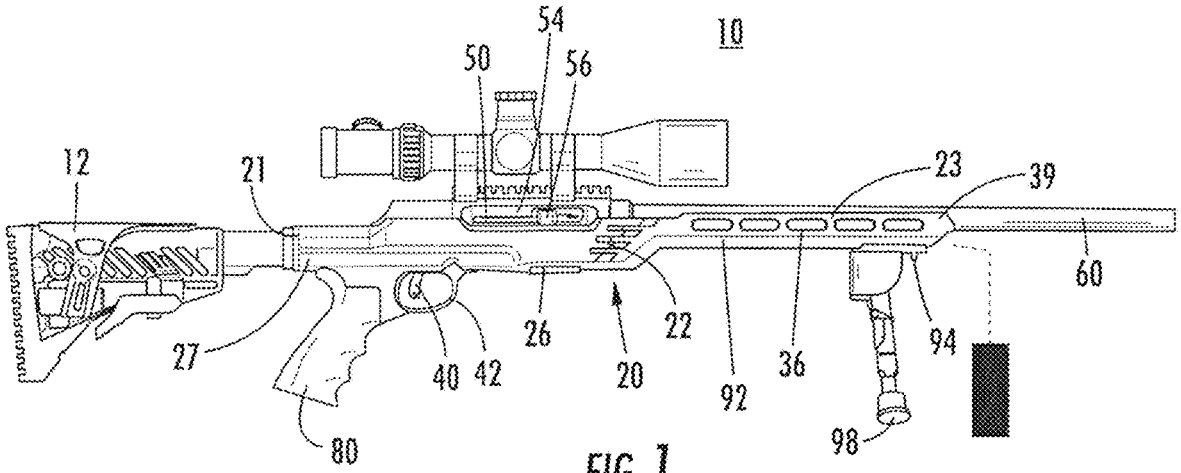
FIG. 1 is a right side view of a firearm provided in accordance with the present disclosure including a barrel, an action, and a tactical chassis system having an integrated rail system.

Embodiments of the present disclosure are now described in detail with reference to the drawings in which like reference numerals designate identical or corresponding elements in each of the several views. Throughout this description, the term "proximal" refers to the portion of the device or component thereof that is closer to a butt of the firearm and the term "distal" refers to the portion of the device or component thereof that is closer to a muzzle or end of a barrel of the firearm.

As used herein, the terms parallel and perpendicular are understood to include relative configurations that are parallel and substantially perpendicular up to about + or −10 degrees from true parallel and true perpendicular.

A modular rifle system including a tactical chassis is described herein. The tactical chassis may include an integrated rail system. The integrated rail system may include a rail interface on the right, left, lower, and/or top surface of the chassis. The tactical chassis may be used with a variety of grips including a pistol grip or a ridgeline grip. The modular rifle system may include a semi-automatic action.

Further provided by the present disclosure is a chassis of a semiautomatic rifle, such as an AR-10 style or AR-15 style rifle, including a lower receiver for receiving the mechanical components of the rifle, a lower forend extending distally from the lower receiver, and an upper forend detachably coupled to the lower forend. The lower forend may be monolithically formed with the lower receiver or detachably connected thereto. The lower receiver is designed to support a majority, and in some instances an entirety, of the weight of a barrel/barrel nut/gas system of the rifle, thereby shifting the center of mass of the rifle proximally/rearwardly to improve accuracy of the rifle. When the upper forend is attached to the lower forend, for example, via a sliding engagement, the upper and lower forends together encapsulate the entire length of the barrel without making contact with the barrel.

The lower receiver may include a barricade stop extending downwardly from a lower surface thereof. The barricade stop is located distally/frontward of a magazine well of the lower receiver. The lower receiver may further define a recess in the lower surface and adjacent the barricade stop. The recess is dimensioned to receive a finger (e.g., an index finger of a non-shooting hand) of the user to prevent the user from grasping a magazine of the rifle.

In another aspect of the present disclosure, the rifle may include one or more weights movably connected to the forend of the chassis. One or more of the weights may be moved to various locations along a length of the forend to adjust a center of gravity of the rifle. For example, the weights may be slid along an exterior or interior of the forend. In other aspects, the weights may be detached from the chassis and re-attached at a different location of the lower forend.

Figure 2:
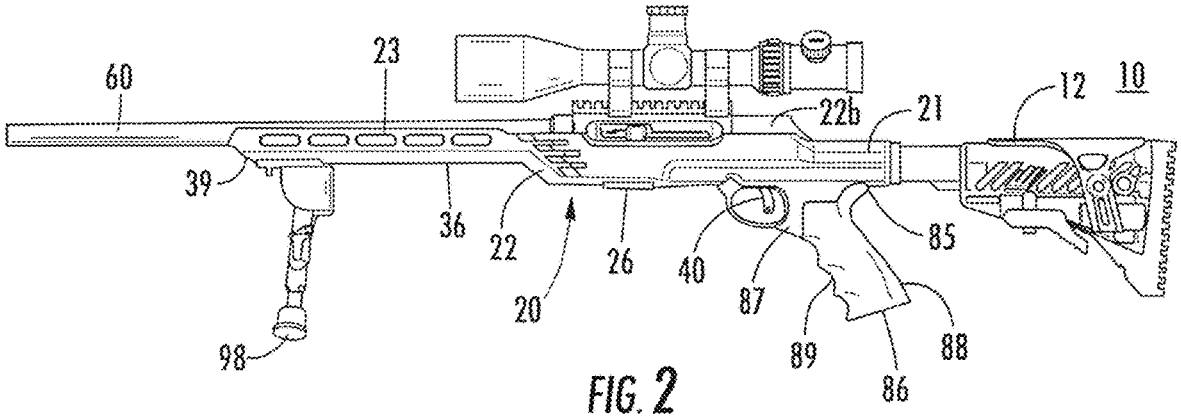
FIG. 2 is a left side view of the firearm in FIG. 1.
Figure 3:
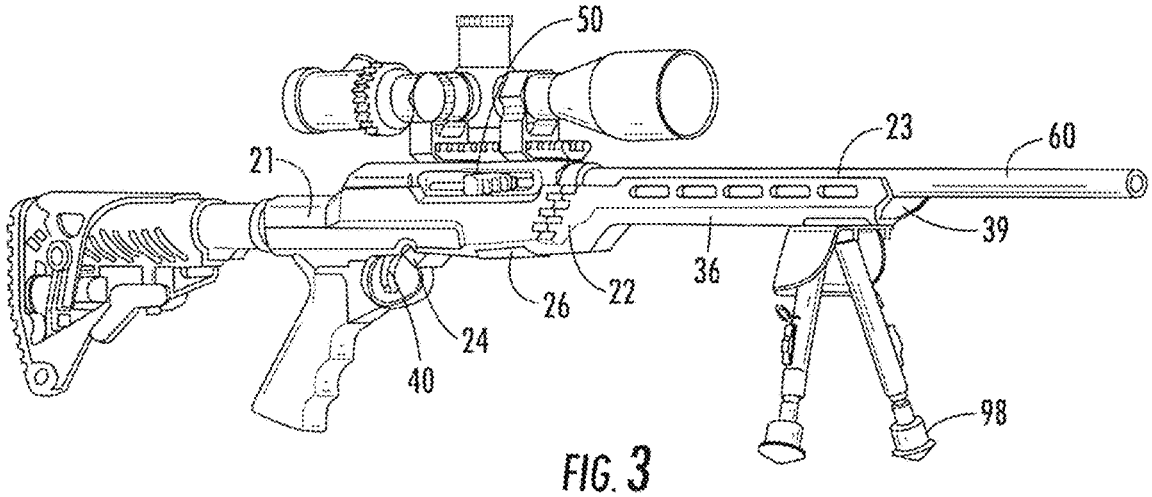
FIG. 3 is a perspective view of the firearm in FIG. 1.

Referring to FIGS. 1-3, a modular rifle system 10 is provided in accordance with the present disclosure and includes a stock 12, a tactical chassis 20, a trigger mechanism 40, an action 50, a barrel 60, and a magazine (not explicitly shown). As shown, the action 50 is a .17 HMR semi-automatic action; however, the action 50 may be a variety of actions including, but not limited to, a .17 HRM action, a .22 LR action, a .22 Magnum action, a .308 action, a .410 action, a rimfire action, a short or long bolt action, a short or long semi-automatic action, a short or long action shotgun action, or a muzzle loader action.

The tactical chassis 20 includes sidewalls 22 that extend from a proximal portion 21 to a distal portion 39. The tactical chassis 20 defines a trigger well 24 (FIGS. 4 and 5) and a magazine well 26 and includes a forearm 36 that extends from the magazine well 26 to the distal portion 39 of the tactical chassis 20. The trigger well 24 receives the trigger mechanism 40 and the magazine well 26 receives a magazine. The magazine may be releasably secured within the magazine well or may be an internal magazine received within the forearm 36 of the tactical chassis 20.

The stock 12 is secured to the proximal portion 21 of the tactical chassis 20. The stock 12 may be integrally formed with or releasably secured to the proximal portion 21 of the tactical chassis 20. As shown, the stock 12 is an adjustable stock; however, the stock 12 may be a fixed stock, a folding stock, or an adjustable folding stock.

Figure 4:
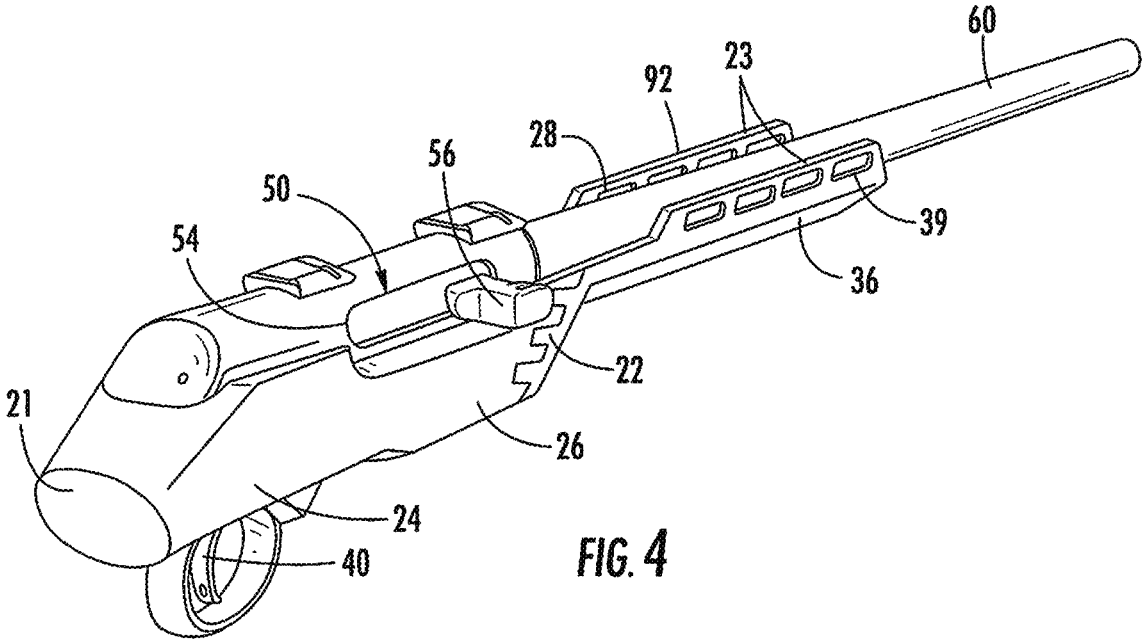
FIG. 4 is an upper back, side perspective view of a portion of the firearm of FIG. 1 illustrating the tactical chassis system, barrel, and action.

Referring now to FIG. 4, the sidewalls 22 of the tactical chassis 20 defines a proximal portion of a channel 28 above the trigger well 24 and the magazine well 26. The channel 28 receives the action 50 and the barrel 60. The proximal portion of the channel 28 cradles about 135° of the action 50 and the barrel 60 such that upper surfaces of the sidewalls 22 are positioned below a centerline of the action 50 and the barrel 60 adjacent the action 50 and the barrel 60.

Figure 5:
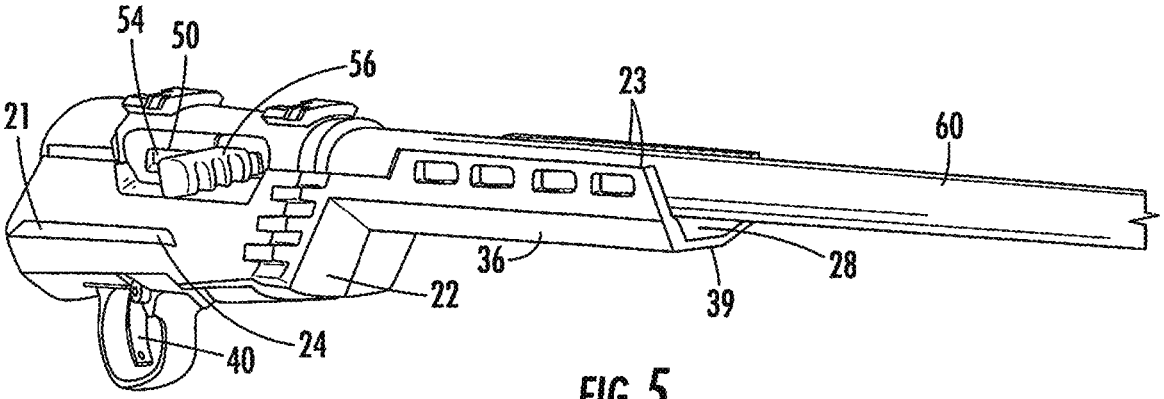
FIG. 5 is a front, side perspective view of the portion of the firearm of FIG. 4.
Figure 6:
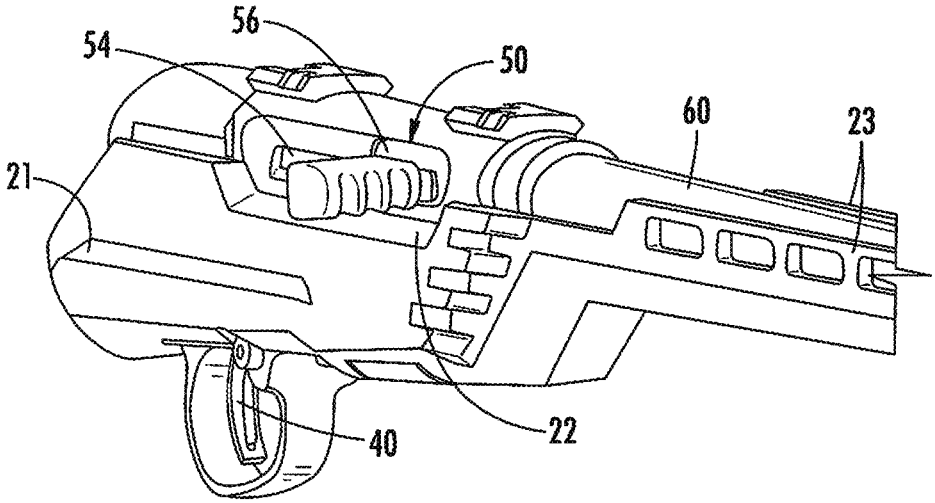
FIG. 6 is an enlarged front, side perspective view of the portion of the firearm of FIG. 4.
Figure 7:
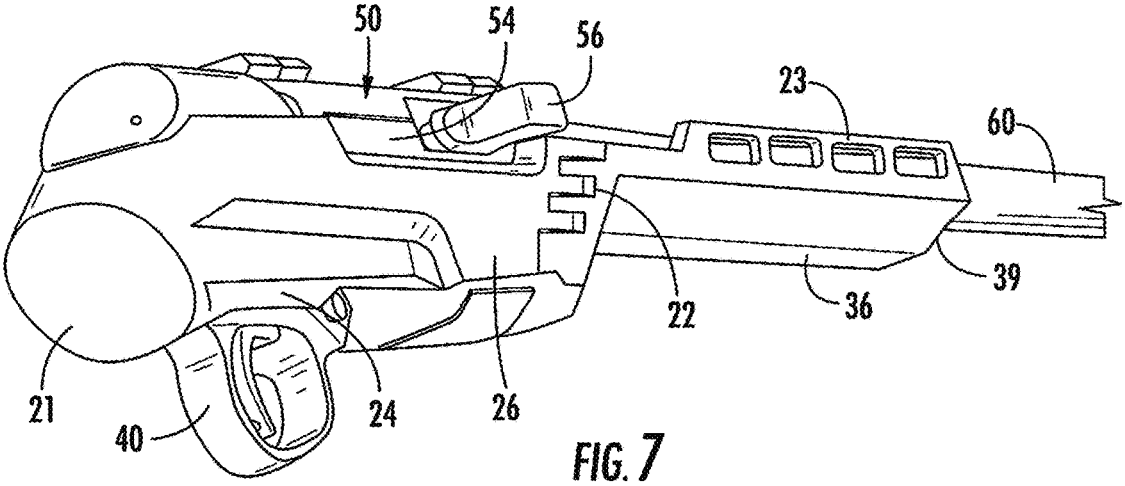
FIG. 7 is a lower back, side perspective view of the portion of the firearm of FIG. 4.

With reference to FIGS. 4-6, the action 50 includes a slide 54 and defines a chamber 52 (FIG. 6). The slide 54 is slidable within the action 50 between a first configuration (FIG. 6) in which the slide 54 is in an open position to provide access to the chamber 52 and a second configuration (FIG. 4) in which the slide 54 is locked in a closed position such that the chamber 52 of the action 50 is closed. In the closed position, the chamber 52 is closed and the trigger mechanism 40 is actuatable to fire a cartridge (not shown) positioned within the chamber 52. The slide 54 includes a slide arm 56 that extends from and is secured to the slide 54. The slide arm 56 is engageable by an end user to manually move the slide 54 between the closed position and the open position. The slide 54 may be biased towards the closed position. It will be appreciated that when the action 50 is a semi-automatic action, the action 50 will transition the slide 54 from the second configuration to the first configuration upon firing of the cartridge and the bias of the slide 54 will return the slide 54 to the second configuration such that the action 50 is prepared to fire a fresh cartridge loaded into the chamber 52.

Referring now to FIGS. 1-7, the tactical chassis 20 is configured to receive a right-handed action 50; however, it is contemplated that the chassis 20 may receive a left-handed or ambidextrous action. As shown, the action 50 is a right-handed action 50 allowing the chamber 52, the slide 54, and the slide arm 56 to be accessed from the right side of the modular rifle system 10. In the closed position, the slide arm 56 is positioned at a distal end of a slide rail 58 within the action 50 as shown in FIG. 6. To move the slide 54 to the open position, the slide arm 56 is slid proximally along the slide rail 58. When the slide arm 56 reaches a proximal end of the slide rail 58, the action 50 is in a fully open position. As the slide 54 slides to the fully open position, a cartridge (not shown) may be ejected from the chamber 52. In the right-handed configuration, the cartridge is ejected from the right side of the chamber 52. As the slide 54 reaches the fully open position, a lower portion of the chamber 54 is opened to allow a new cartridge from the magazine (not shown) to enter the chamber 52. Alternatively, a new cartridge may be placed directly into the chamber 52 when the slide 54 is in the open position.

When a new cartridge is within the chamber 52, the slide arm 56 is engaged to slide the slide 54 distally towards the closed position. As the slide 54 slides distally along the slide rail 58, the new cartridge is positioned or loaded into the chamber 52. When the slide 54 reaches the closed position, the slide arm 56 is located at the distal end of the slide rail 58. The slide 54 may be biased towards the closed position such that the slide 54 automatically slides distally to load the new cartridge and to close the chamber 52.

Referring now to FIG. 5, the forearm 36 includes rail portions 23 that extend from the forearm 36 such that each of the rail portions 23 extends above the centerline of the barrel 60. Each of the rail portions 23 defines a rail interface system 92 (FIG. 1) that is monolithically formed with the tactical chassis 20 such that the tactical chassis 20 is configured to receive accessories as detailed below. Additionally, or alternatively, a lower surface of the forearm 36 may define a lower rail interface system 94 configured to receive accessories. For example, the lower rail interface system 94 may receive a bipod 98 (FIG. 1). In addition, the lower rail interface system 94 may receive a foregrip (not shown)

As shown, the rail interface system 92 and the lower rail interface system 94 are M-LOK® rail systems, which is a rail system that is commonly known in the art and is shaped to receive M-LOK® accessories. It is also contemplated that other rail systems that are commonly known in the art may be monolithically formed in the rail portions 23 and lower portion of the forearm 36 of the tactical chassis 20 including, but not limited to, a Picatinny rail system, a KeyMod rail system, or other rail systems as will be familiar to the skilled practitioner.

Referring back to FIGS. 1-3, the modular rifle system 10 includes a pistol grip 80 that protrudes conspicuously below the action 50 of the rifle 10 to allow for a pistol style grasp in which the web of the trigger hand (between the thumb and index finger) can be placed below the top exposed portion of the trigger mechanism 40 while firing. The pistol grip 80 includes an upper portion 84 that forms an elliptical shape such that the web of the firing hand can rest comfortably below the top exposed portion of the trigger mechanism 40 and a lower portion 86 that extends proximally and downward to form an acute angle with respect to the proximal portion 21 of the tactical chassis 20. It is contemplated that the upper portion 84 of the pistol grip 80 may form different shapes to receive the web of the firing hand and that the lower portion 86 of the pistol grip 80 may protrude from the chassis 20 at any angle to allow for a pistol style grasp.

The pistol grip 80 has a proximal side 88 that is contoured to receive a palm of a firing hand. It is contemplated that the contour of the proximal side 88 may take on any shape to comfortably receive the palm of the user's hand. The pistol grip 80 has a distal side 89 that contains ridges to receive non-trigger fingers of a firing hand of an end user. It is contemplated that the ridges may take on any shape or depth to comfortably receive the non-trigger fingers. It is also contemplated that the distal side 89 of the pistol grip 80 may be smooth. The distal side 89 may include an upper end portion 87 that is contoured to sit flush with a radius of a trigger guard 42 of the trigger mechanism 40. The pistol grip 80 is secured to the tactical chassis 20 by a fastener 82 (FIG. 9) that passes through the upper end portion 87.

Figure 8:
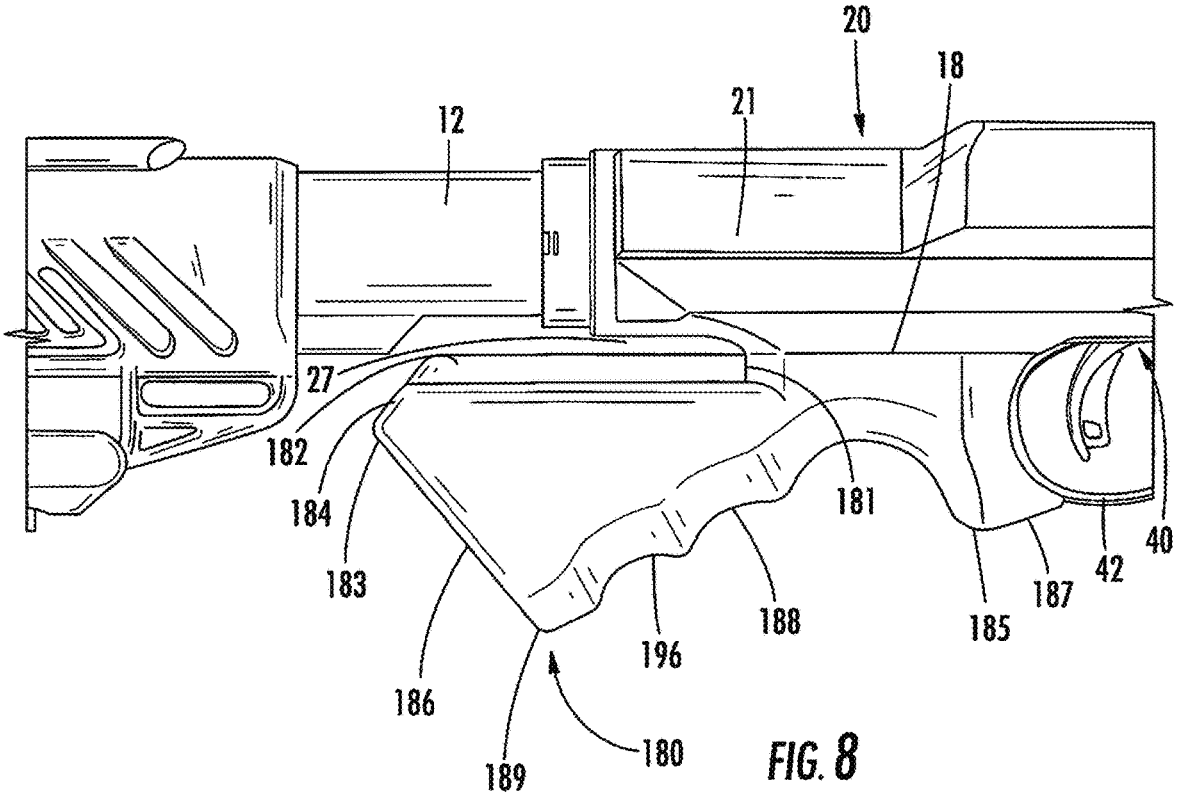
FIG. 8 is a side view of a portion of the firearm of FIG. 1 with a ridgeline grip provided in accordance with the present disclosure.
Figure 9:
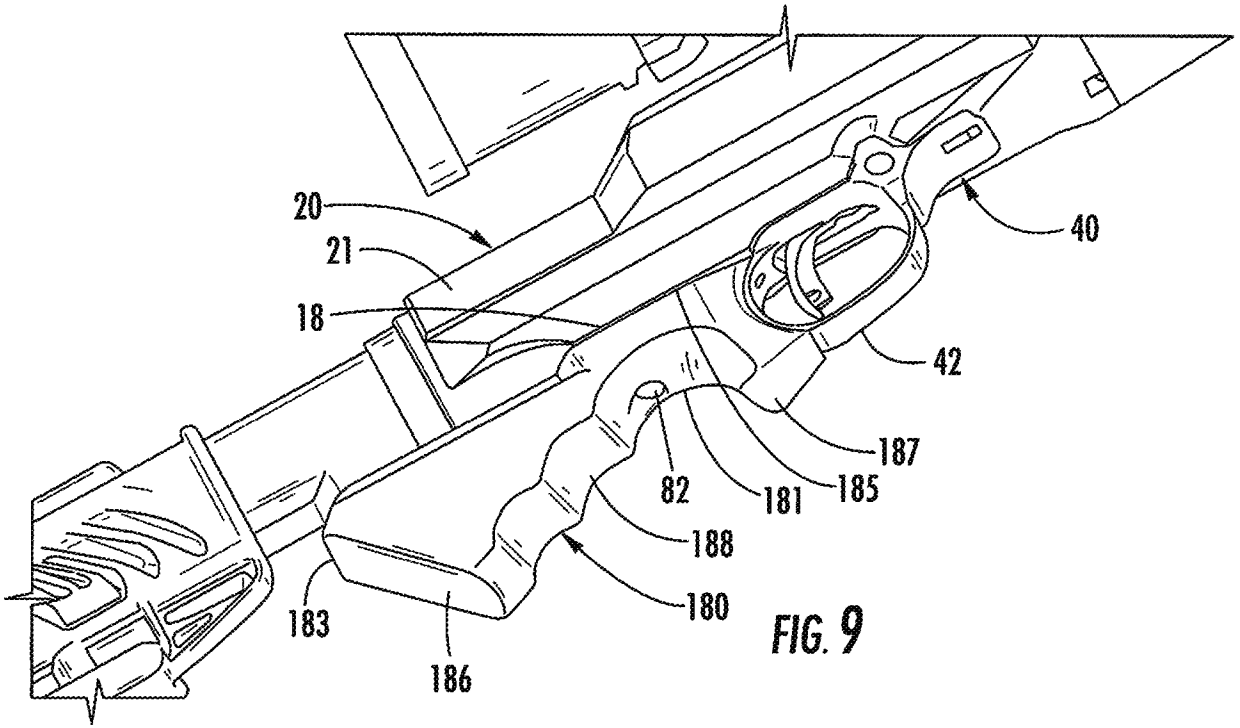
FIG. 9 is a lower perspective view of the portion of the firearm of FIG. 8.

Referring now to FIGS. 8 and 9, a ridgeline grip 180 is provided in accordance with the present disclosure. The ridgeline grip 180 is secured to a lower surface 18 of the proximal portion 21 of the tactical chassis 20 by a fastener 82 (FIG. 9). The ridgeline grip 180 includes a connecting surface 185 that is secured to the tactical chassis 20 with the fastener 82 such that the connecting surface 185 of the ridgeline grip 180 is flush with the lower surface 18 of the tactical chassis 20. When the ridgeline grip 180 is secured to the tactical chassis 20, the ridgeline grip 180 extends from the trigger guard 42 of the trigger mechanism 40 to a proximal well 27 of the proximal portion 21 of the tactical chassis 20.

The connecting surface 185 of the ridgeline grip 180 forms a corner with a proximal well wall 181 that descends a short distance to an exposed upper surface 182 of the ridgeline grip 180. The upper surface 182 of the ridgeline grip 180 extends proximally from the proximal well wall 181 beyond a proximal end of the proximal portion 21 of the tactical chassis 20 such that a portion of the upper surface 182 opposes the stock 12. As shown, a proximal tip 183 of the ridgeline grip 180 forms an angled surface 184 between the exposed upper surface 182 and a back edge 186 of the ridgeline grip 180. The backside wall 186 extends from the angled surface 184 to a lower tip 189 of the ridgeline grip 180. The angled surface 184 and the back edge 186 of the ridgeline grip 180 may meet at a variety of angles. The angled surface 184 may be a smooth curve or a plurality of surfaces to form polygonal shape when viewed from the side between the exposed upper surface 182 and the back edge 186.

The ridged face 188 of the ridgeline grip 180 extends from the lower tip 189 to a distal strut 187 of the ridgeline grip 180. The ridged face 188 of the ridgeline grip includes distinct ridges 190 to receive non-trigger fingers of a firing hand. As shown, the ridges 190 are radial in shape; however, it is contemplated that the ridges 190 may take on any shape or depth to comfortably receive non-trigger fingers. The distal strut 187 of the ridgeline grip 180 is contoured to sit flush with the trigger guard 42 of the trigger mechanism 40 such that the distal strut 187 flushingly receives the trigger guard 42.

The ridgeline grip 180 protrudes slightly below the trigger guard 42 of the modular rifle system 10 to allow for a rifle style grasp in which the web of the trigger hand can be placed above, or at the same level as, the top exposed portion of the trigger mechanism 40 during firing. The ridgeline grip 180 extends below the action to a lesser extent than the pistol grip 80 (FIG. 1) and does not allow for a pistol style grasp.

With particular reference to FIG. 9, the ridgeline grip 180 is secured to the tactical chassis 20 by the fastener 82. The fastener 82 passes through the distal strut 187 of the ridgeline grip 180 to secure the ridgeline grip 180 to the proximal portion 21 of the tactical chassis 20.

It is contemplated that a tactical chassis (e.g., tactical chassis 20) and grip (e.g., pistol grip 80 or ridgeline grip 180) may be constructed from the same material or made from different materials. Contemplated materials for the chassis and grips include, but are not limited to, natural materials (e.g. wood), man-made materials (e.g., Kevlar), composite materials (e.g., carbon fiber), metals, metal alloys, synthetic materials, laminated materials, compressed woven materials, and any combination thereof.

Figure 10:
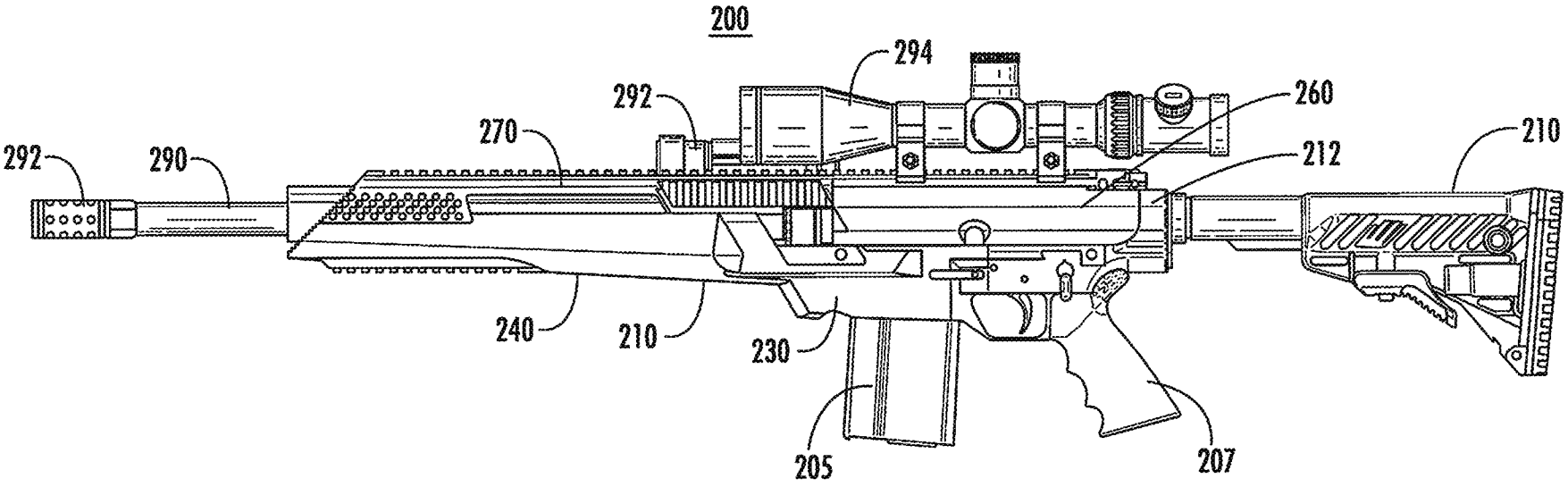
FIG. 10 is a side view of another firearm provided in accordance with the present disclosure.
Figure 11:
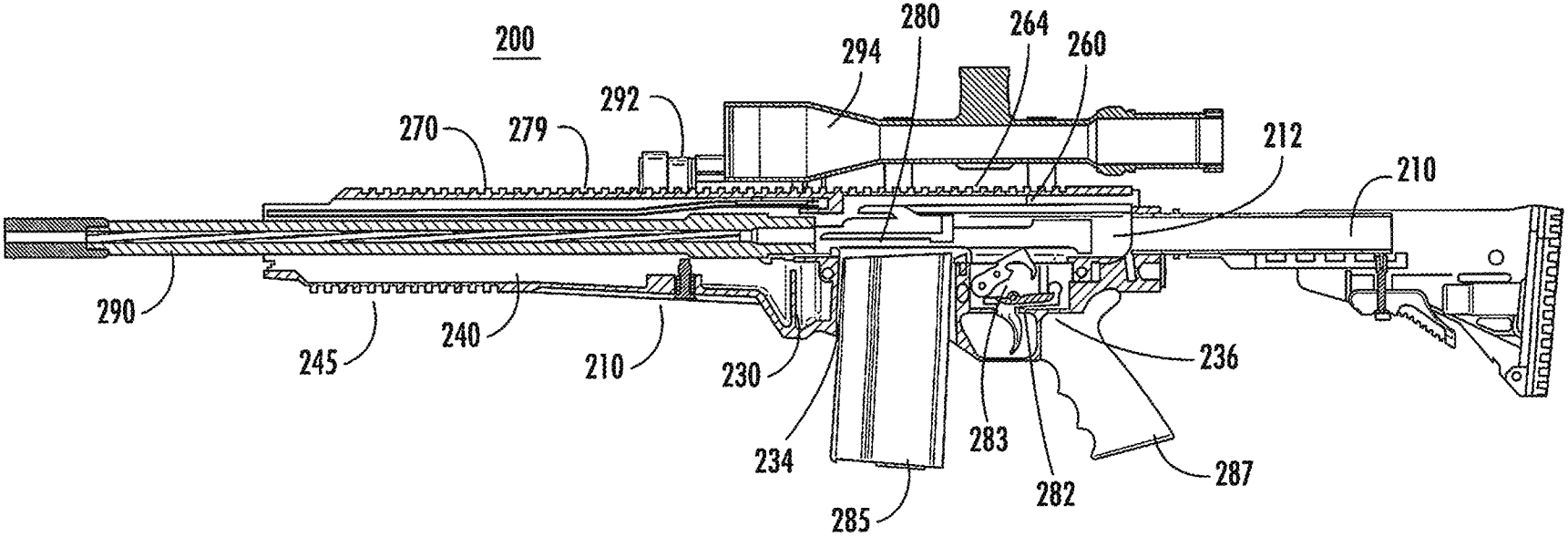
FIG. 11 is a side cross-sectional view of the firearm of FIG. 10.
Figure 12:
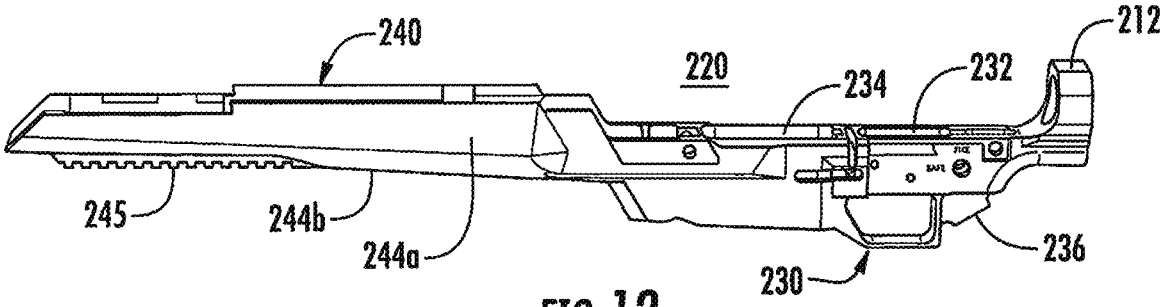
FIG. 12 is a side view of a lower chassis of the firearm of FIG. 10.
Figure 13:
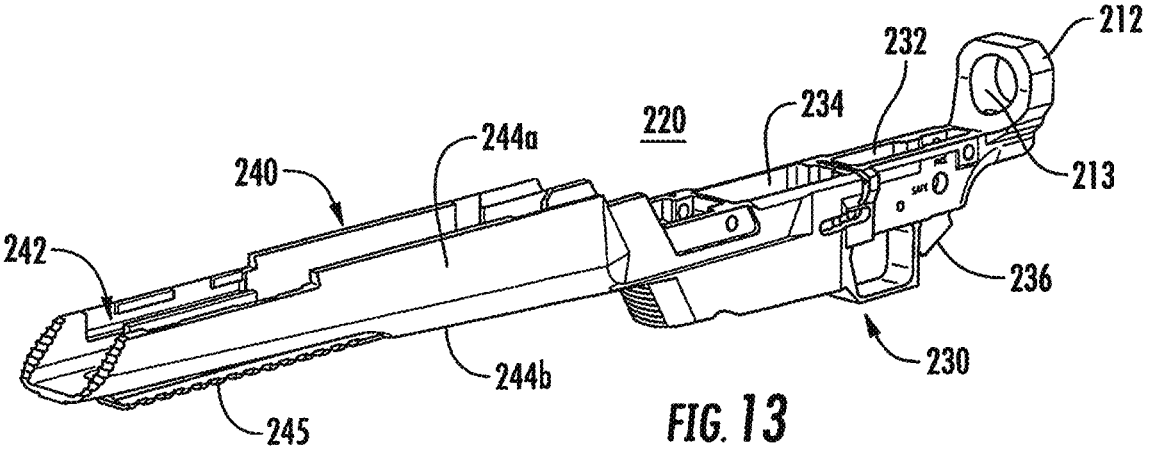
FIG. 13 is a perspective view of the lower chassis of FIG. 12.
Figure 14:
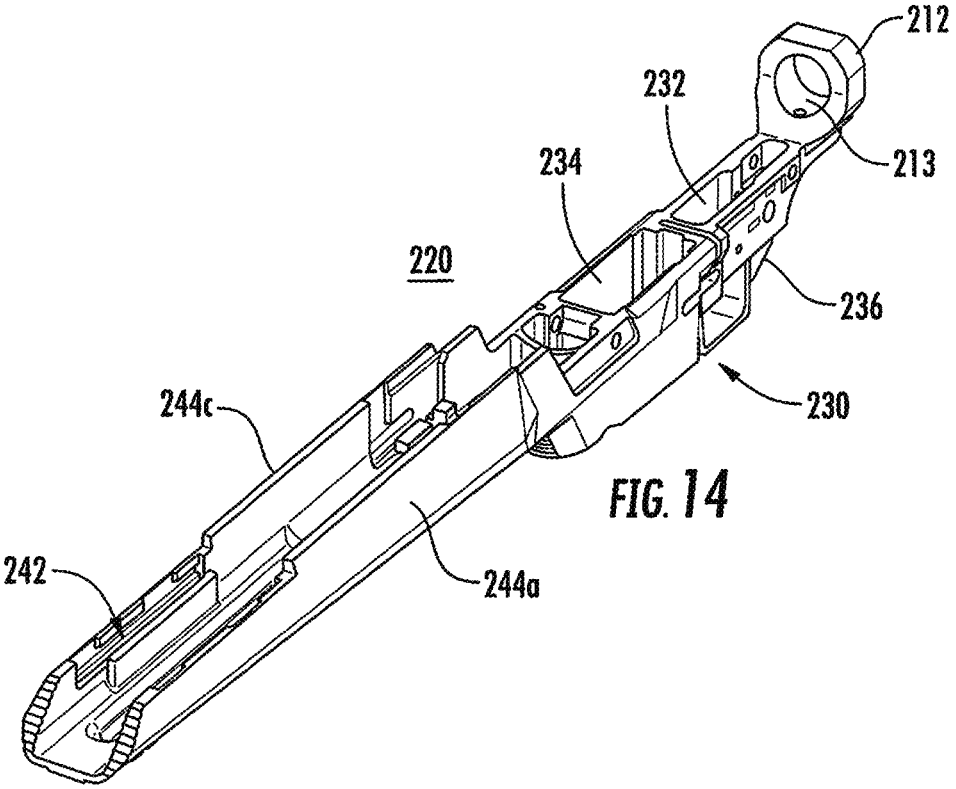
FIG. 14 is a top perspective view of the lower chassis of FIG. 12.
Figure 15:
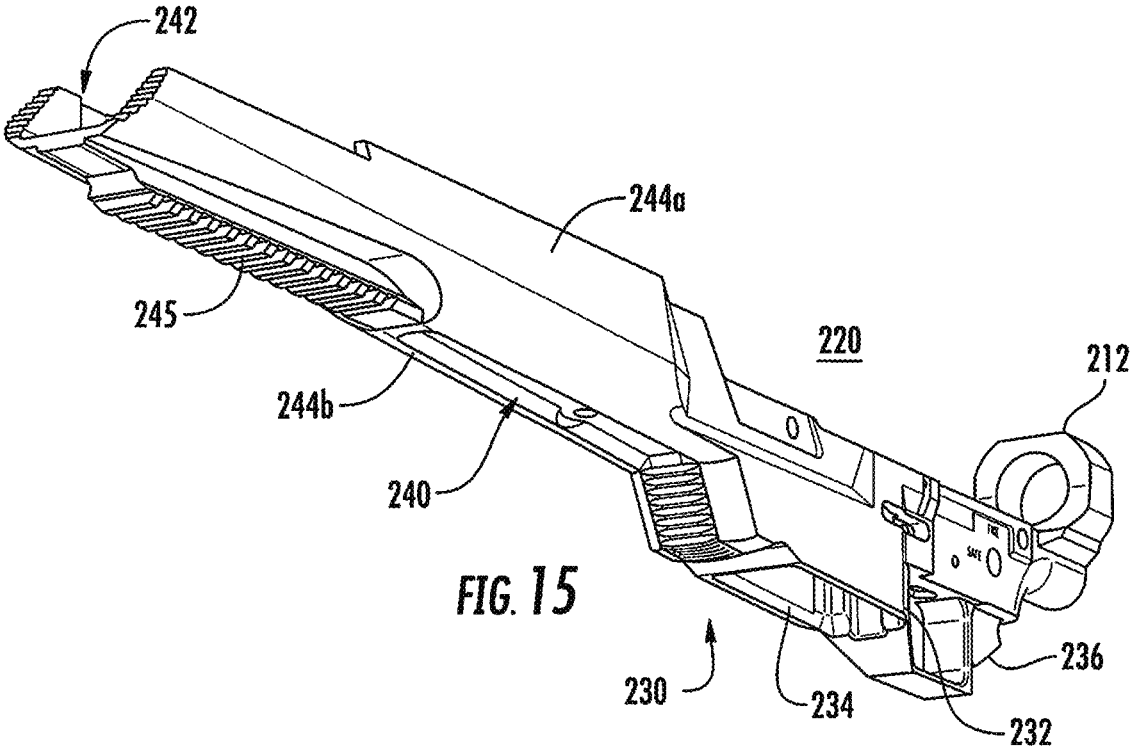
FIG. 15 is a bottom perspective view of the lower chassis of FIG. 12.

With reference to FIGS. 10 and 11, another firearm 200 is provided in accordance with the present disclosure which includes a stock 210, a lower chassis 220, an upper receiver 260, an upper forend 270, an action 283, a magazine 285, a grip 287, a barrel 290, and a break 292 secured to the barrel 290.

Referring to FIGS. 12-16, the lower chassis 220 includes, from a proximal end to a distal end, a stock mount 212, a lower receiver 230, and a lower forend 240. The entire lower chassis 220 is monolithically formed which may form a stable platform for components of a rifle system. Forming a stable platform may improve the accuracy and/or precision of a firearm, e.g., firearm 200 (FIG. 10), built on the lower chassis 220. In addition, by having the lower receiver 230 monolithically formed in the lower chassis 220, the lower chassis 220 may be considered a registered firearm.

The stock mount 212 defines a distal portion of the lower chassis 220 and is substantially circular in shape. The stock mount 212 is configured to secure a stock, e.g., stock 210 (FIG. 10), to the lower chassis 220. An inner surface 213 of the stock mount 212 may be threaded such that a stock may be threaded into the stock mount 212. In some embodiments, a bugger tube (not shown) passes through the stock mount 212. In some embodiments, the stock mount 212 is separate from the lower chassis 220 and is secured to the lower chassis 220 by one or more fasteners or a fastening system (not shown). In certain embodiments, the stock mount 212 is monolithically formed, integrally formed, or secured to the upper receiver 260 (FIG. 10).

Figure 16:
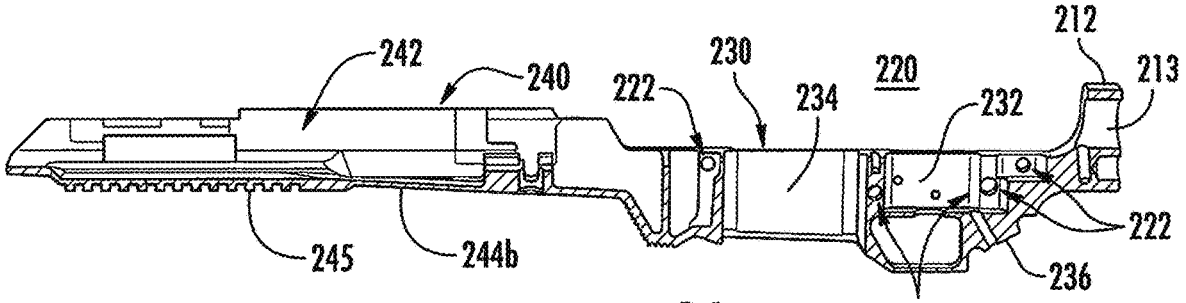
FIG. 16 is a side cross-sectional view of the lower chassis of FIG. 12.

With particular reference to FIG. 16, the lower receiver 230 includes a trigger well 232, a magazine well 234, and a grip mount 236. The trigger well 232 is configured to at least partially receive an action, e.g., action 283 (FIG. 11). The action 283 may be any suitable action. For example, the action 283 may be rimfire or center fire, may be semi-automatic or fully automatic, and may be a variety of calibers, e.g., 0.17, 0.17-223, 0.20, 0.204, 0.220, 0.222, 0.223, 0.22, 0.224, 0.243, 0.25, 0.270, 0.277, 0.30, 0.300, 0.30-06, 0.308, 0.338, 0.358, 0.375, 0.45, 0.500, 5.45, 5.56, 6 mm, 6.5 mm, 7 mm, 20 Gauge, 12 Gauge, .410, etc. In some embodiments, the lower receiver 230 is an AR-15, AR-10, or a clone equivalent or modified clone equivalent thereof.

The magazine well 234 is configured to receive a magazine, e.g., magazine 285 (FIG. 11), that may be fixed to or removable from the lower receiver 230 and configured to hold one or more cartridges of suitable ammunition for the action 283 received in the trigger well 232. As shown, the magazine well 234 is positioned distal of the trigger well 232; however, the magazine well 234 may be positioned proximal of the trigger well 232. The magazine well 44 is configured to feed cartridges into a chamber as detailed below.

The grip mount 236 is configured to secure a grip, e.g., grip 287 (FIG. 11) to the lower receiver 230. The grip may be any suitable grip, e.g., a pistol grip or a ridgeline grip. In some embodiments, no grip is secured to the grip mount 236.

The lower receiver 230 may also include openings 238 that are configured to receive fasteners to secure components, e.g., a magazine, an action, or a grip, to the lower receiver 230. The lower chassis 220 may also include openings 222 that are configured to receive fasteners to secure the upper receiver 260 and/or the upper forend 270 to the lower chassis 220.

The lower forend 240 of the lower chassis 220 is substantially U-shaped in lateral cross-section to define a channel 242 therein. Channel 242 is configured to receive a barrel, e.g., barrel 290 (FIG. 11). The lower forend 240 has one or more flat surfaces 244*a*, 244*b*, 244*c* (FIGS. 14 and 15) that may include mounting systems such as rails integrally formed thereon. For example, the lower surface 244*b* of the lower forend 240 includes a lower rail 245 that is configured to mount one more accessory, e.g., a strap, bipod, tripod, light, laser sight, etc., to the lower chassis 220. The lower rail 245 extends longitudinally along the lower surface 244*b* such that the one or more accessories to be mounted in a plurality positions longitudinally spaced apart from one another along the lower rail 245. In some embodiments, the lower rail 245 is monolithically formed in the lower surface 244*b* of the lower forend 240. Alternately, the lower rail 245 may be secured to the lower surface 244*b* by one or more fasteners.

The lower forend 240 extends distally from the magazine well 234. As shown, the lower forend 240 is monolithically formed with the lower receiver 230. In some embodiments, the lower forend 240 may be formed of one or more components. For example, the lower forend 240 may have a proximal portion that is monolithically formed with the lower receiver 230 and extends distally from the magazine well 234 and is then secured to a distal portion of the lower forend 240 by one or more fasteners. The proximal portion of the lower forend 240 may extend distally in a range of about 0.5 inches to about 28 inches from the magazine well 234. Extending the lower forend 240 has shown to increase the precision and accuracy of firearms based on a chassis with a monolithically formed lower forend 240.

Figure 17:
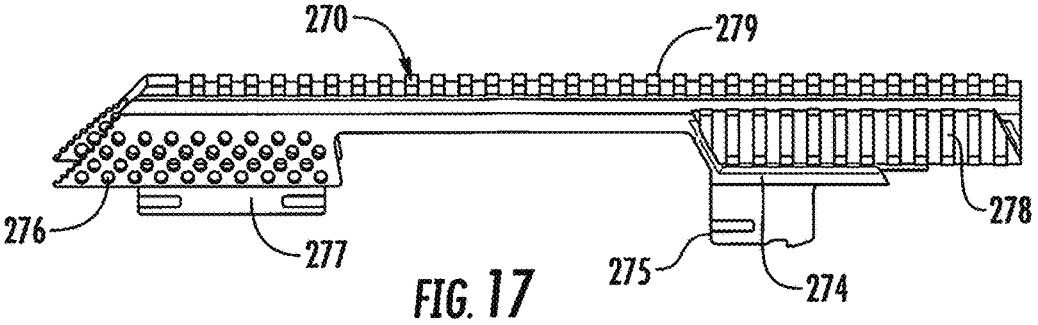
FIG. 17 is a side view of an upper forend of the firearm of FIG. 10.
Figure 18:
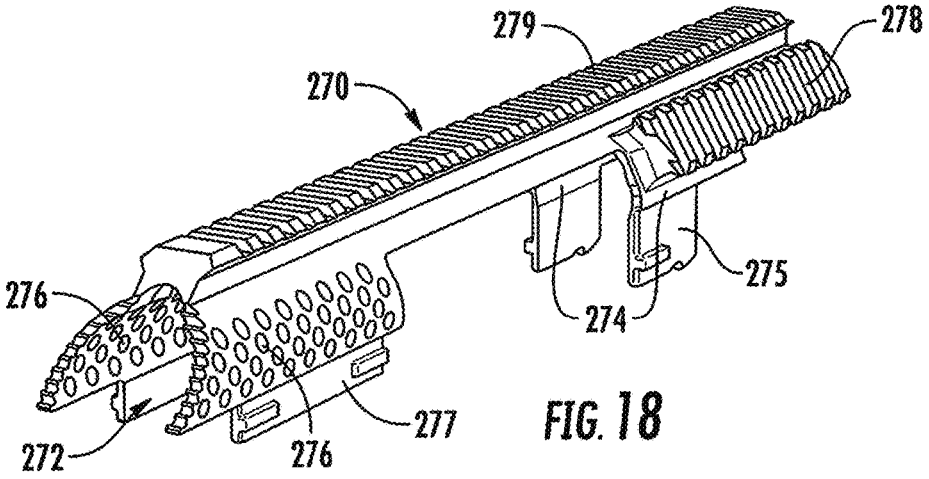
FIG. 18 is a perspective view of the upper forend of FIG. 17.
Figure 19:
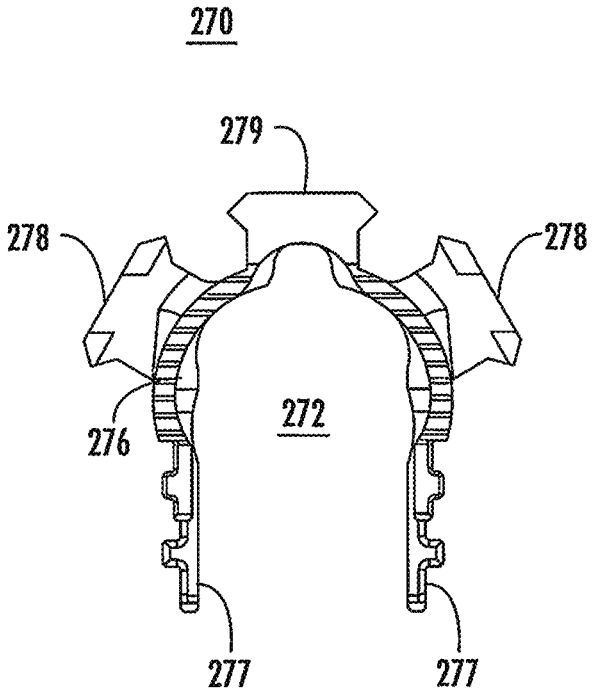
FIG. 19 is a front view of the upper forend of FIG. 17.
Figure 20:
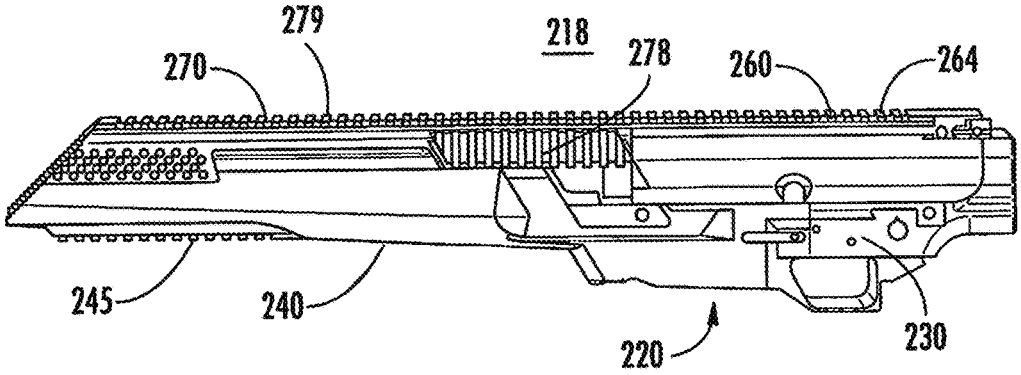
FIG. 20 is a side view of a body of the firearm of FIG. 10 including the lower chassis, the upper forend, and an upper carrier.
Figure 21:
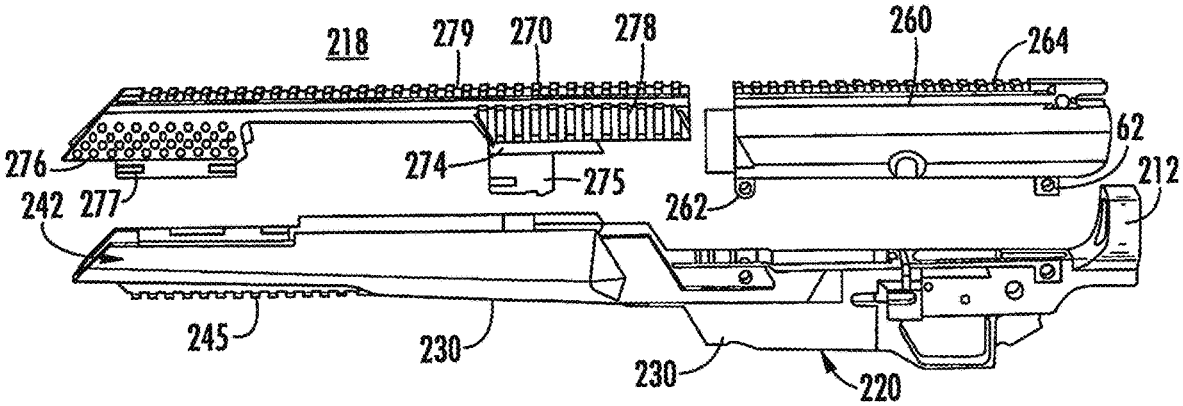
FIG. 21 is a side view, with parts separated, of the body of FIG. 20.
Figure 22:
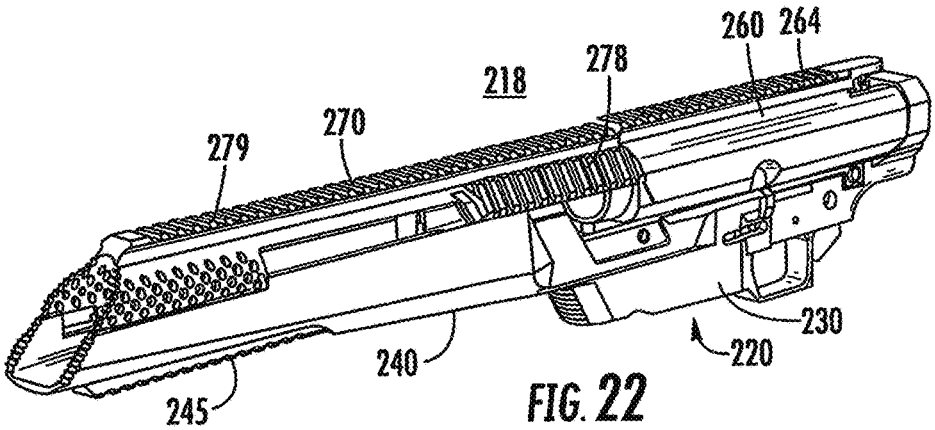
FIG. 22 is a perspective view of the body of FIG. 20.
Figure 23:
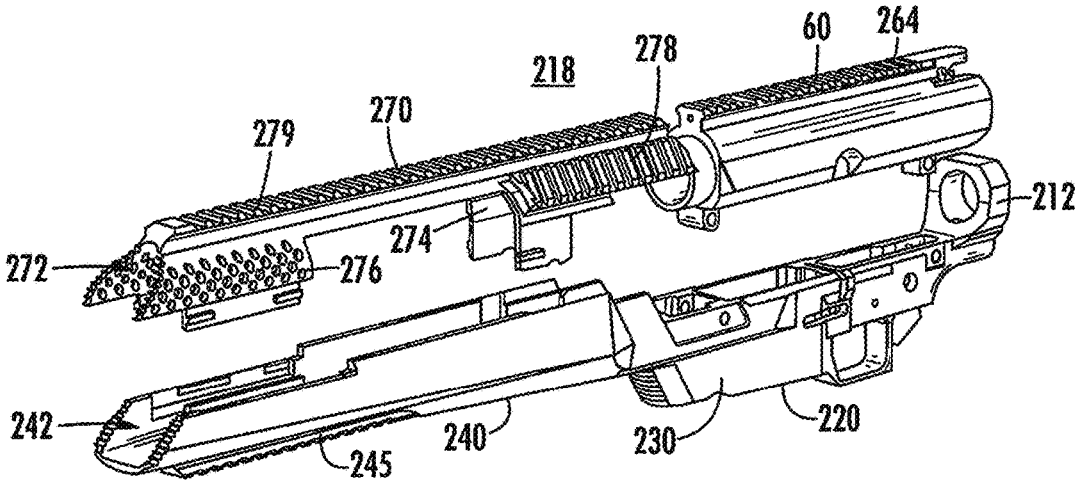
FIG. 23 is a perspective view, with parts separated, of the body of FIG. 20.

With particular reference to FIGS. 17-19, the upper forend 270 is configured to integrally join with the lower chassis 220 over the lower forend 240. The upper forend 270 has a pair of proximal legs 274 and a pair of distal legs 276 which are each laterally spaced apart to define an upper channel 272 therebetween. The pair of proximal legs 274 and the pair of distal legs 276 are longitudinally spaced apart from one another along the upper channel 272. Each of the proximal legs 274 and distal legs 276 may include a lower mounting surface 275, 277 that is secured to the lower forend 240. The lower mounting surfaces 275, 277 may receive a fastener to secure each of the proximal and distal legs 274, 276 to the lower forend 240. In some embodiments, the each of the lower mounting surfaces 275, 277 include a portion of a fastening system, e.g., a portion of a slide lock, that interfaces with another portion of the fastening system on the lower forend 240 to secure the upper forend 270 with the lower forend 240 of the lower chassis 220. In some embodiments, the lower mounting surfaces 275, 277 are welded to the lower forend 240.

In embodiments, the upper forend 270 is monolithically formed with the lower forend 240 of the lower chassis 220. When the upper forend 270 is monolithically formed with the lower forend 240, the proximal and distal legs 274, 276 may not extend into the lower forend 240 and be formed with the lower forend 240 along a center line of the channel 242.

The upper channel 272 may form a portion of the channel 242 and receive a portion of a barrel, e.g., barrel 290 (FIG. 10). The upper forend 270 may include a top rail 279 that extends along a length of an upper surface thereof. The top rail 279 may extend along a substantial or entire length of the upper surface of the upper forend 270. The proximal legs 274 may include angled surfaces which include an angled rail 278. The angled rail 278 extends in a direction parallel to a longitudinal axis of the upper channel 272 and is radially offset to the top rail 279 at an angle in a range of about 15 degrees to about 90 degrees about the longitudinal axis of the upper channel 272. As shown in FIG. 18, the angled rail 278 is offset about 30 degrees from the top rail 279. The upper forend 270 may include an angled rail 278 on one or both of the proximal legs 274. In some embodiments, the upper forend 70 is provided without an angled rail 278. In other embodiments, the upper forend 70 includes an angled rail 278 on each of the proximal and distal legs 272, 274. In certain embodiments, the upper forend 270 includes an angled rail 278 that is continuous from a proximal leg 274 to a distal leg 276. In particular embodiments, one or more of the proximal legs 274 includes an angled rail 278 offset at a first angle, e.g., about 45 degrees, and one or more of the distal legs 276 includes an angled rail 278 offset at a second angle, e.g., about 90 degrees, that is different from the first angle.

With additional reference to FIGS. 20-24, the lower chassis 220, the upper receiver 260, and the upper forend 270 form a body 218 for a firearm, e.g., firearm 200 (FIG. 10). The lower chassis 220 and the upper forend 270 may be monolithically or integrally formed with one another. In some embodiments, the upper receiver 260 and the upper forend 270 are monolithically or integrally formed with one another. In embodiments, the lower chassis 220, the upper receiver 260, and the upper forend 270 are monolithically or integrally formed with one another.

Figure 24:
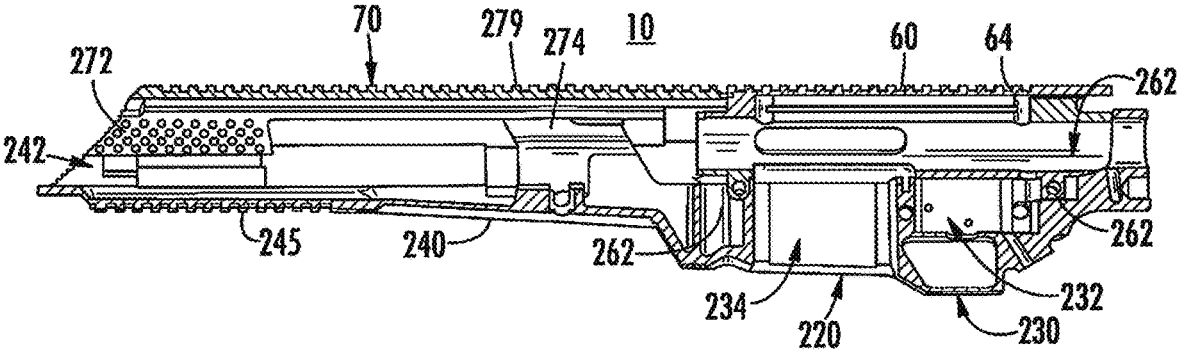
FIG. 24 is a side cross-sectional view of the body of FIG. 20.

With particular reference to FIG. 24, the upper receiver 260 secures over the trigger well 232 and the magazine well 234 of the lower chassis 220. The upper receiver 260 may partially receive a portion of an action therein, e.g., action 283 (FIG. 11). For example, as shown in FIG. 11, a bolt carrier 280 may be received within the upper receiver 260. The upper receiver 260 may be secured to the lower receiver 230 of the lower chassis 220 by one or more fasteners passing through legs or tabs 262 of the upper receiver 260. The upper receiver 260 may also include an upper rail 264 that extends along an upper surface of the upper receiver 260. The upper rail 264 may form a continuous rail with the top rail 279 of the upper forend 270. While not shown, the upper receiver 260 may include one more angled rails similar to the angled rails 278 detailed above.

The upper receiver 260 may also include an upper rail 264 that extends along an upper surface of the upper receiver 260. The upper rail 264 may form a continuous rail with the top rail 279 of the upper forend 270. While not shown, the upper receiver 260 may include one more angled rails similar to the angled rails 278 detailed above.

The body 218 may include a plurality of rails as detailed individually above. For example, the lower chassis 220 may include the lower rail 245, the upper receiver 260 may include an upper rail 264, and the upper forend 270 may include one or more angled rails 278 and an upper rail 279. The rails 245, 264, 278, 279 may be used to mount one or more accessories to the firearm 200, e.g., light 292 or scope 294 (FIG. 10). The upper rails 264, 279 may form a single continuous rail with a portion of a single accessory being mounted or secured to each of the upper rails 264, 279.

Figure 25:
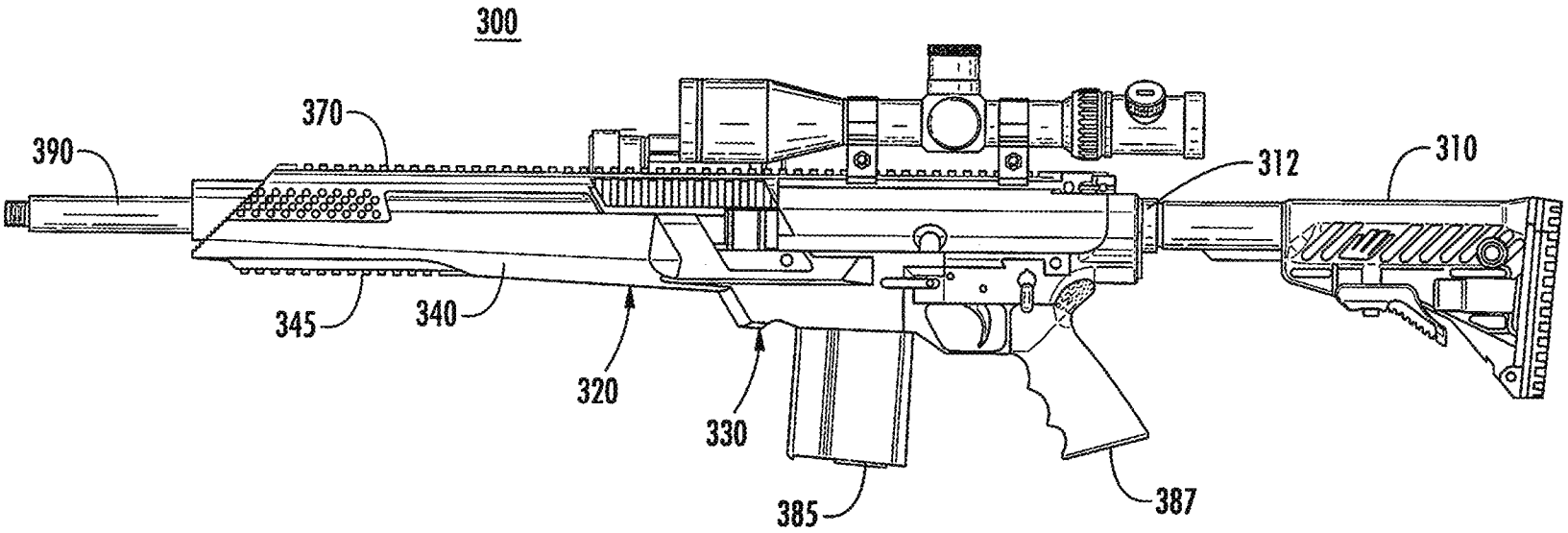
FIG. 25 is a side view of another firearm provided in accordance with the present disclosure.
Figure 26:
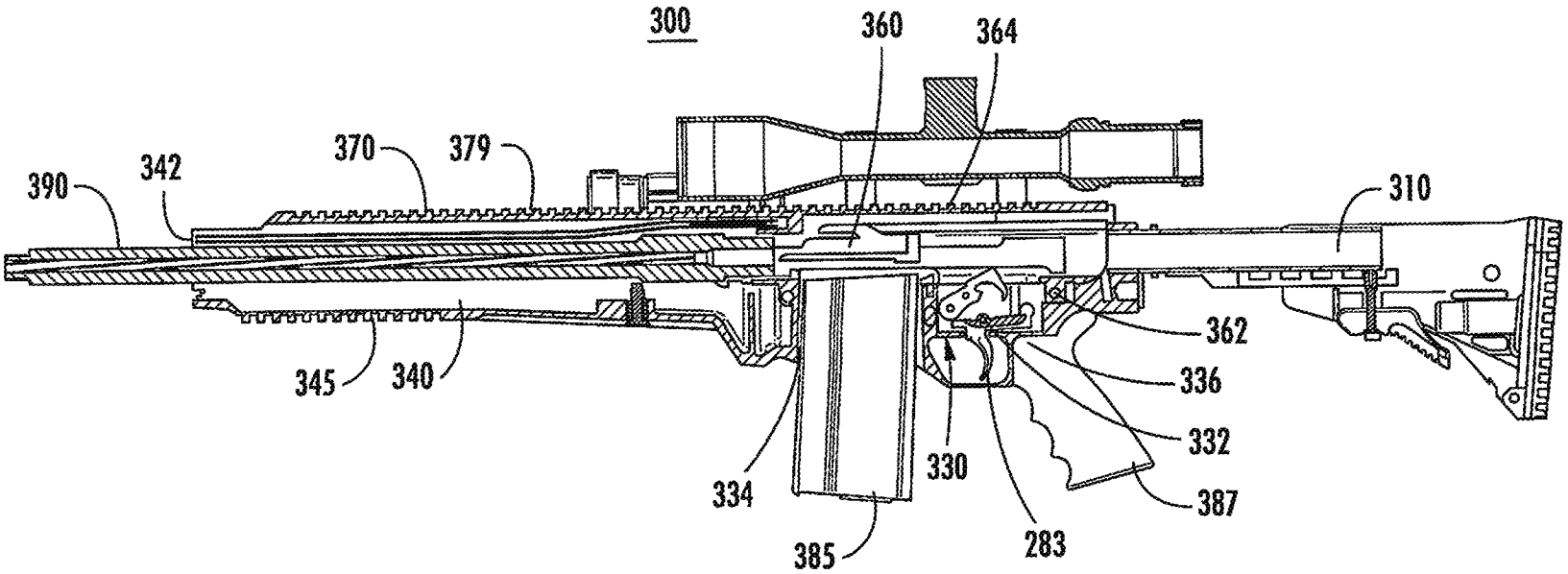
FIG. 26 is a side cross-sectional view of the firearm of FIG. 25.
Figure 27:
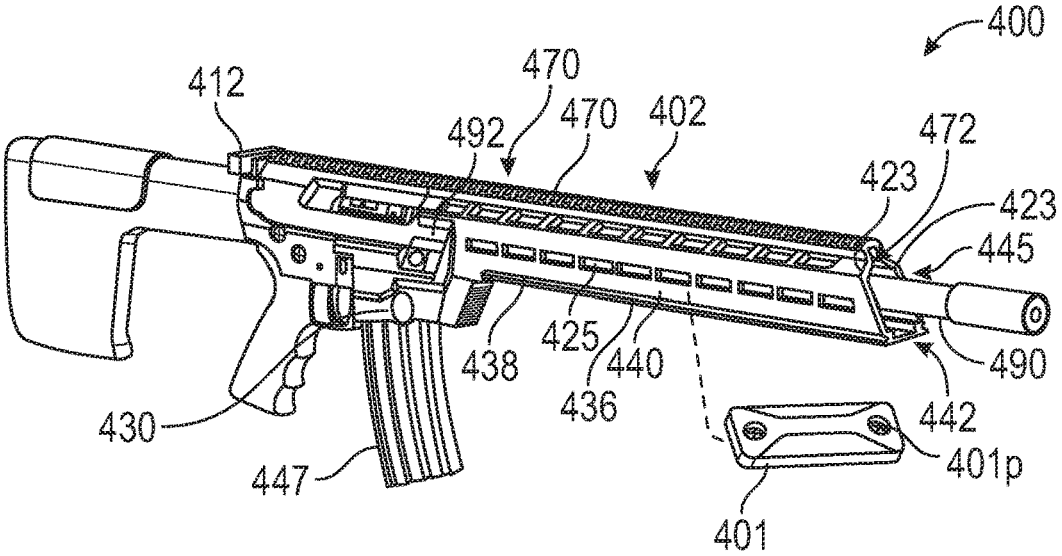
FIG. 27 is a perspective view of a firearm illustrating a weight disassembled from a chassis of the firearm.

With reference to FIGS. 25 and 26, another firearm 300 is provided in accordance with the present disclosure. The firearm 300 includes several components that are similar to the components of firearm 200 detailed above with similar components having similar labels with a "3" replacing the "2" of the previous label, e.g., the upper carrier 360 of firearm 300 is similar to the upper receiver 260 of firearm 200. For reasons of brevity selected differences between firearm 300 and firearm 200 will be detailed below.

The firearm 300 includes a lower chassis 320 monolithically formed with an upper forend 370 which define a channel 342 therebetween to receive a barrel 390. The upper carrier 360 is secured to the lower chassis 320 by fasteners passed through tabs 362 as shown in FIG. 25. An action 383 is disposed within a trigger well 333 of a lower receiver 330 of the lower chassis 320 before the upper carrier 360 is secured thereto. The firearm 300 also includes a magazine 385, a pistol grip 387, and a stock 310. Channel 342 may be further configured to receive accessories, e.g., a weight 401.

With reference to FIGS. 27-30, an alternative embodiment of a firearm 400 is provided, similar to the firearms described above. For reasons of brevity, only selected differences between firearm 400 and the firearms above are detailed below.

The firearm 400 may be a semi-automatic firearm, such as, for example, an AR-10 or AR-15 style rifle (including clones and hybrids thereof) including features that may enable performance substantially similar to a Bolt action firearm. The firearm 400 generally includes a firearm chassis 402 (FIG. 27) and a barrel 490 (e.g., a 16, 18 or 20 inch barrel) supported in the chassis 402. The chassis 402 includes a lower receiver 430 and a lower forend 440 milled from a single material (e.g. aluminum billet). In aspects, the chassis 402 may be formed from a plastic. In other aspects, the lower receiver 430 and the lower forend 440 may be integrally connected to one another via a suitable fastening engagement rather than being monolithically formed. The lower forend 440 defines a lower channel 442 along a length thereof allowing the barrel 490, including a barrel nut 492 (FIGS. 27, 30), to be free-floating within the lower forend 440. The lower forend 440 may define a picatinny rail 436 along a bottom surface 438 thereof or any other suitable rail system.

The chassis 402 further includes an upper forend 470 detachably coupled to the lower forend 440. The upper forend 470 is slidably coupled to the lower forend 440 to allow for detachment of the upper forend 470 from the lower forend 440. In aspects, the upper forend 470 may be detachably connected to the lower forend 440 via other fastening engagements, such as, for example, a snap-fit engagement.

The upper forend 470 defines an upper channel 472. When the upper forend 470 is coupled to the lower forend 440, the lower and upper channels 442, 472 of the respective forends 440, 470 together define an enclosed channel or lumen 445 therethrough dimensioned for receipt of the barrel 490. The lumen 445 has a diameter sized so that the inner surfaces of the lower and upper forends 440, 470 remain out of contact with the barrel 490 along the length of the barrel 490. Having the barrel 490 spaced inwardly from the inner periphery of the upper and lower forends 470, 440 has been found to improve accuracy.

The lower receiver 430 supports the proximal end of the barrel 490 (e.g., the barrel nut 492), such that a majority, and in some instances an entirety, of the weight of the barrel 490 (and gas line) is supported by the lower receiver 430. The barrel nut 492 is configured to connect to a proximal end of the barrel 490 or otherwise form a part of the proximal end of the barrel 490. The lower receiver 430 includes a barricade stop 403 (FIG. 30) protruding downwardly therefrom and defines a relief cut or recess 441 disposed between a magazine well 434 of the lower receiver 430 and a proximal end of the lower forend 440. The relief cut 441 may be placed in front of the magazine well 434 where a user's finger can rest, keeping the user's hand off of a magazine 447 of the firearm 400.

Figure 28:
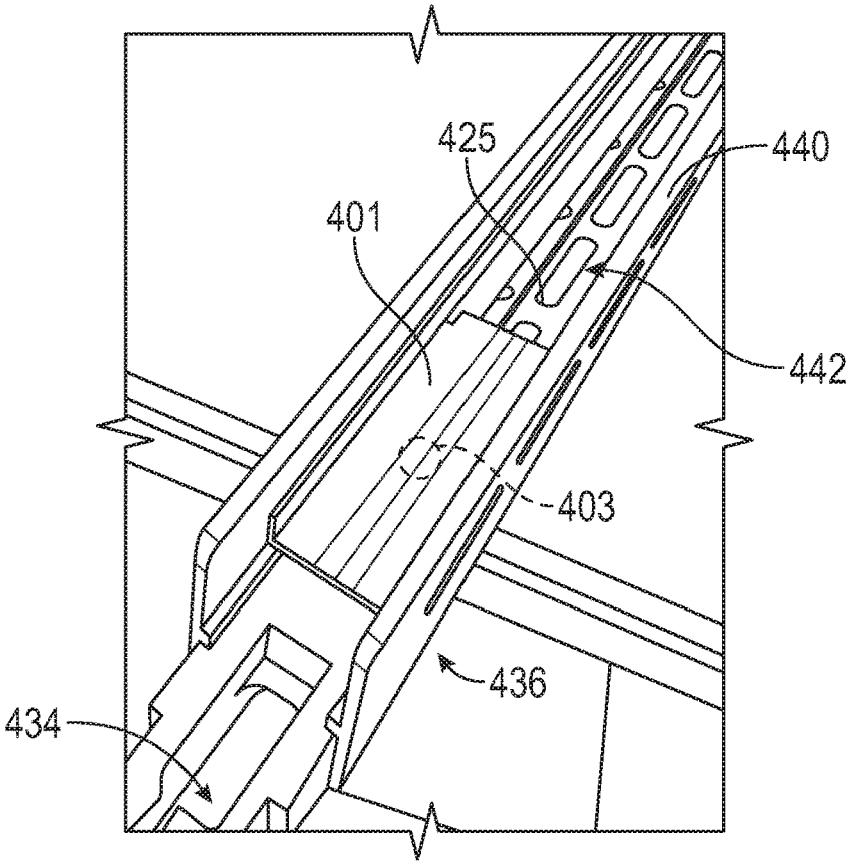
FIG. 28 is a top perspective view, with an upper forend of the chassis removed, illustrating the weight connected to a lower forend of the chassis of FIG. 27.
Figure 29:
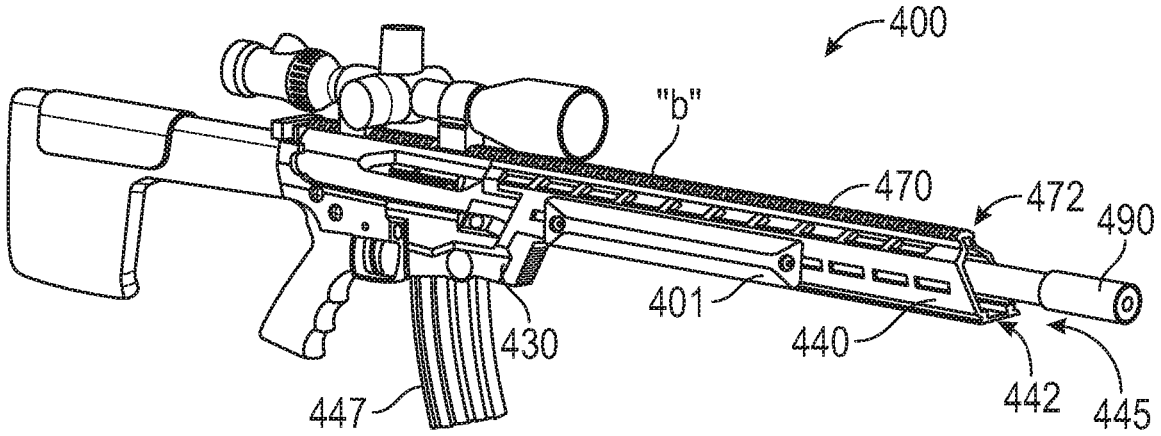
FIG. 29 is a perspective view of the firearm of FIG. 27 illustrating the weight assembled to the chassis.
Figure 30:
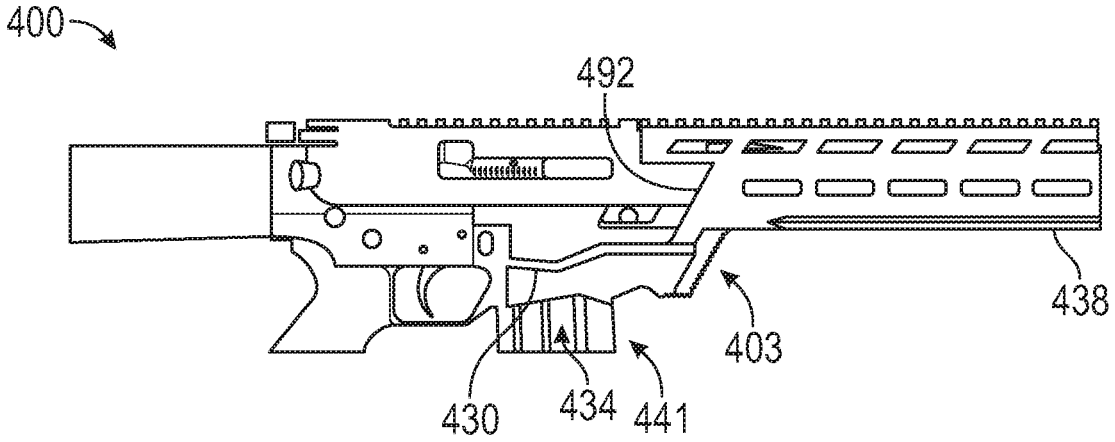
FIG. 30 is a side view of a portion of the firearm of FIG. 29.

The firearm 400 further includes a weight 401 movably coupled to the lower forend 440. As best shown in FIG. 28, the weight 401 is slidably received in the channel 442 of the lower forend 440 without contacting the barrel 490 and being prevented from moving into the lower receiver 430. Longitudinal movement of the weight 401 to different positions along the length of the lower forend 440 adjusts a center of mass of the firearm 400. In other aspects, the weight 401 may be attached to an exterior surface of the lower or upper forends 440, 470. The firearm 400 can be configured to isolate the lower receiver 430 from outside influences (e.g., the force exerted by weight 401). Further, the lower forend 440 may include anchoring components that may aid with fixing the weight 401 to the firearm 400, e.g., a row of longitudinally-spaced openings 425 defined in the lower forend 440.

For example, the weight 401 may include a tab or protrusion (not explicitly shown) configured for removable receipt in the respective openings 425 of the lower forend 440 to selectively fix the weight 401 in an axial position within the lower forend 440. In other aspects, the weight 401 may define a conduit 403 transversely therethrough dimensioned for receipt of a fastener, such as, for example, a bolt (not explicitly shown). During use, a user may connect weight 401 to a selected axial position along the lower forend 440 by inserting the bolt through the opening 403 of the weight 401 and the selected opening 425 to ultimately restrict or substantially limit axial movement of the weight 401 relative to the lower forend 440. In other aspects, the weight 401 may be magnetic or metallic and the lower forend 440 may have a plurality of longitudinally-spaced magnetic or metallic elements to which the magnetic weight 401 is magnetically attracted to allow for the selective fixation of the weight 401 along various axial positions of the lower forend 440.

The weight 401 is an accessory configured to connect to firearm 400 or any of the above-listed firearms and is shown having a rectangular shape. However, weight 401 may have other shapes such as circular, triangular, trapezoidal, or other suitable shapes. The weight 401 is configured to increase the weight of the firearm 400 or a portion thereof.

With reference to FIGS. 31-49, yet another alternative embodiment of a firearm 500 is provided, similar to the firearm 400 described above. For reasons of brevity, only selected differences between firearm 500 and firearm 400 may be detailed below.

Figure 31A:
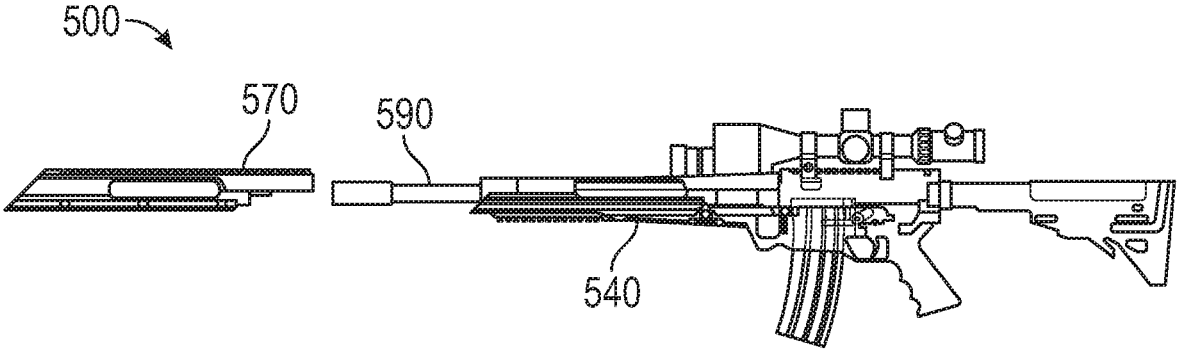
FIG. 31A is a side view of the firearm of FIG. 31, with parts removed, illustrating an upper forend of a chassis separated from the rest of the firearm.
Figure 31:
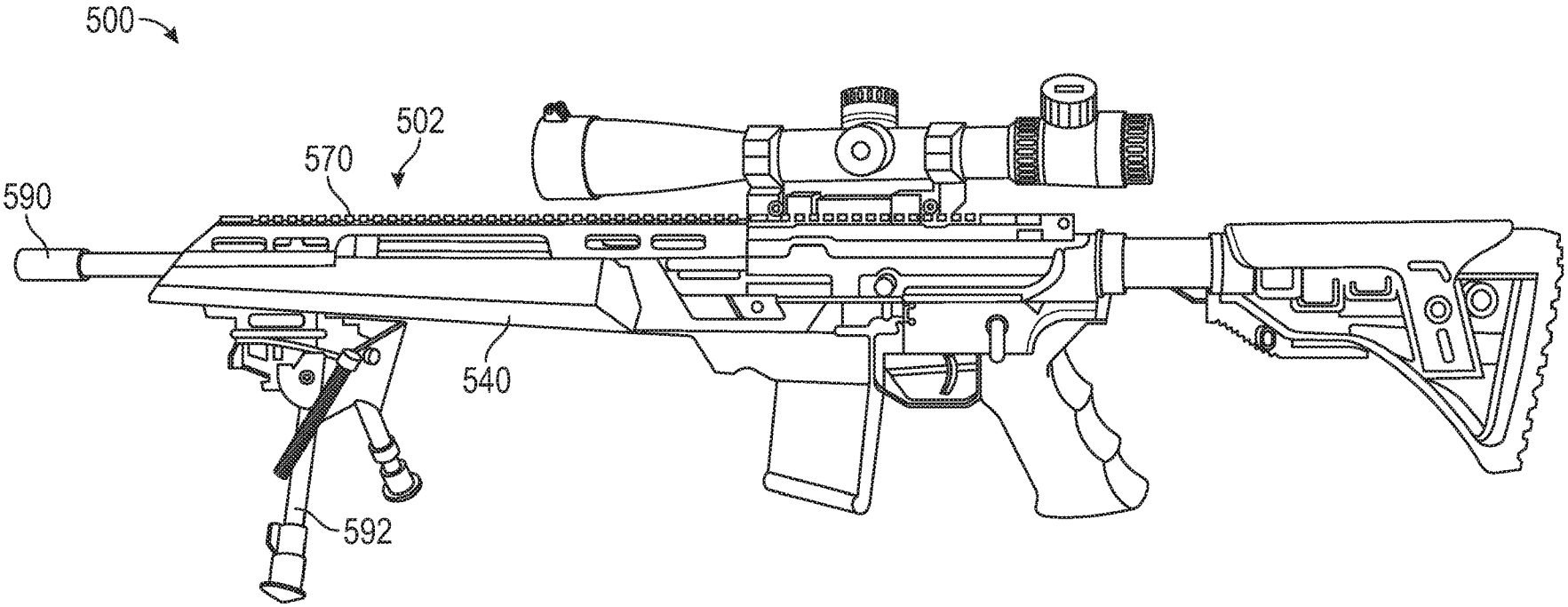
FIG. 31 is a perspective view of a firearm provided in accordance with the present disclosure.
Figure 32:
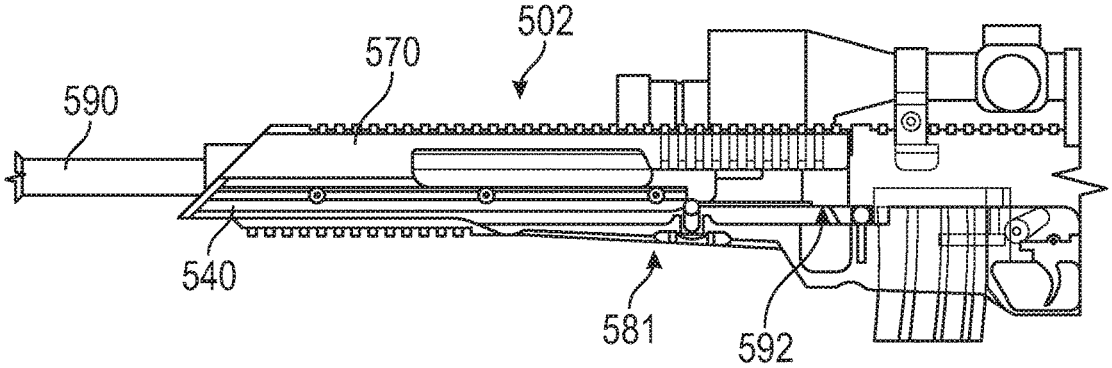
FIG. 32 is a side view of a portion of the firearm arm of FIG. 31 illustrating the upper forend of the chassis connected to the rest of the firearm.
Figure 33:
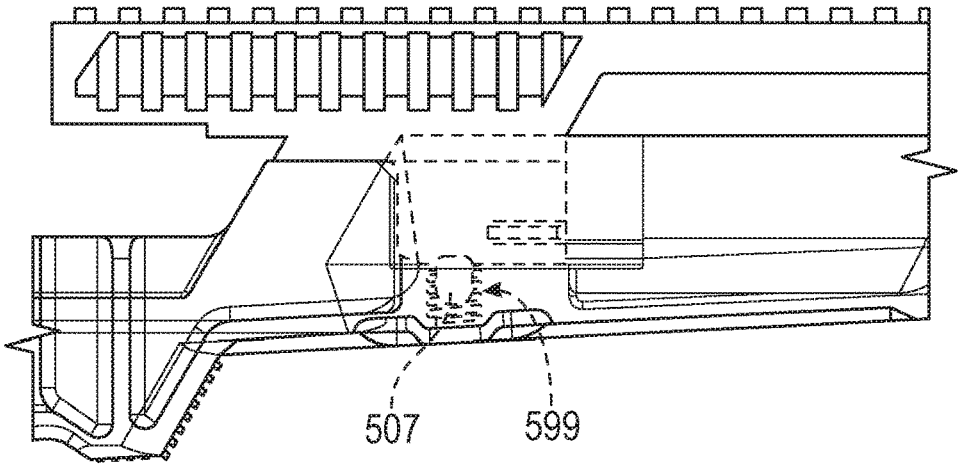
FIG. 33 is an enlarged view of a portion of the fire arm of FIG. 32 illustrating a fastening system for selectively securing the upper forend to the lower forend.
Figure 34:
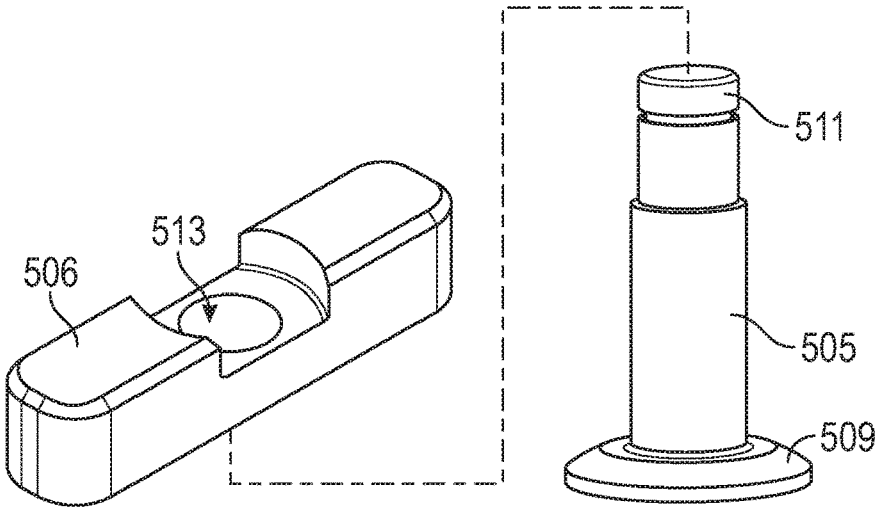
FIG. 34 is an enlarged view illustrating elements of the fastening system of FIG. 33 in a disassembled state.
Figure 35:
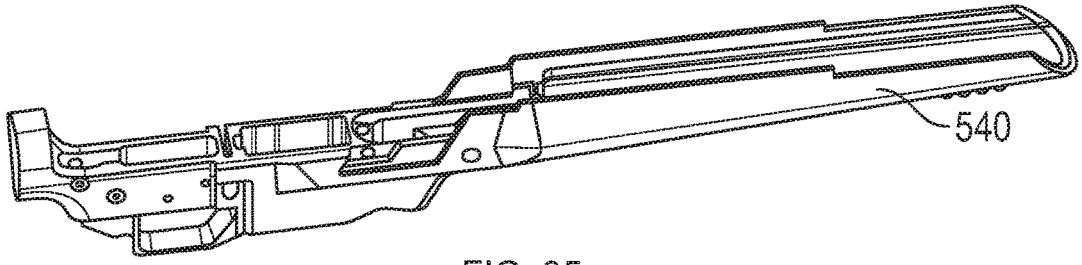
FIG. 35 is a perspective view of the lower forend of the firearm of FIG. 31.
Figure 36:
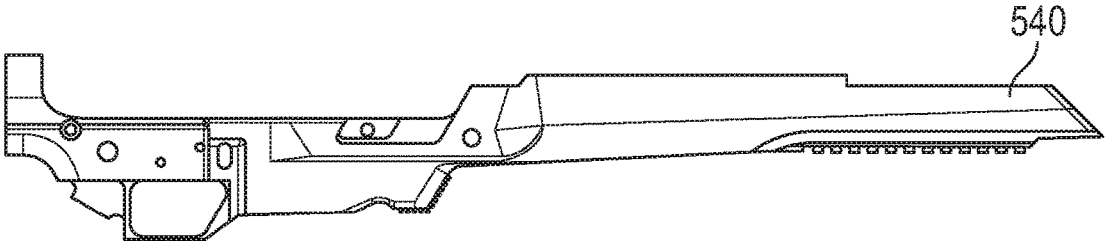
FIG. 36 is a right side view of the lower forend of FIG. 35.
Figure 37:
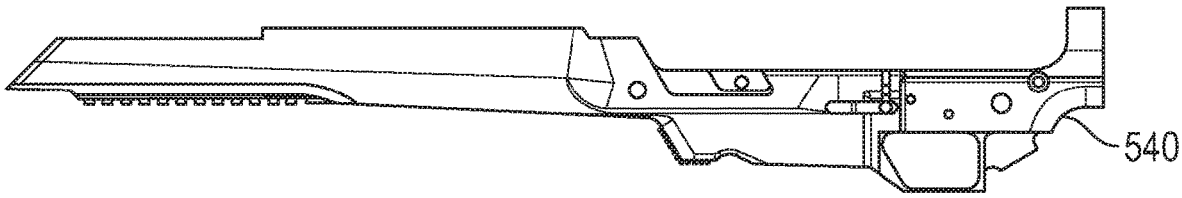
FIG. 37 is a left side view of the lower forend of FIG. 35.
Figure 38:
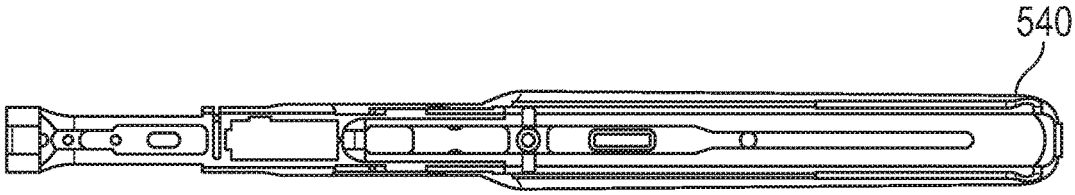
FIG. 38 is a top view of the lower forend of FIG. 35.
Figure 39:
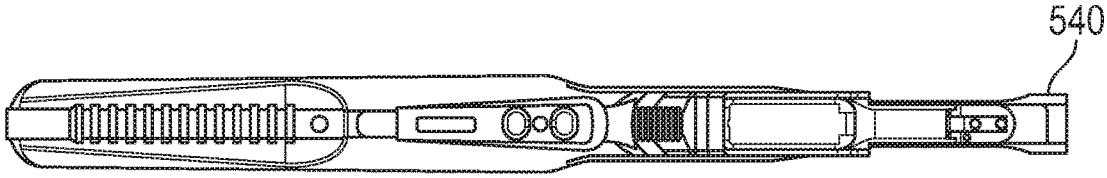
FIG. 39 is a bottom view of the lower forend of FIG. 35.
Figure 40:
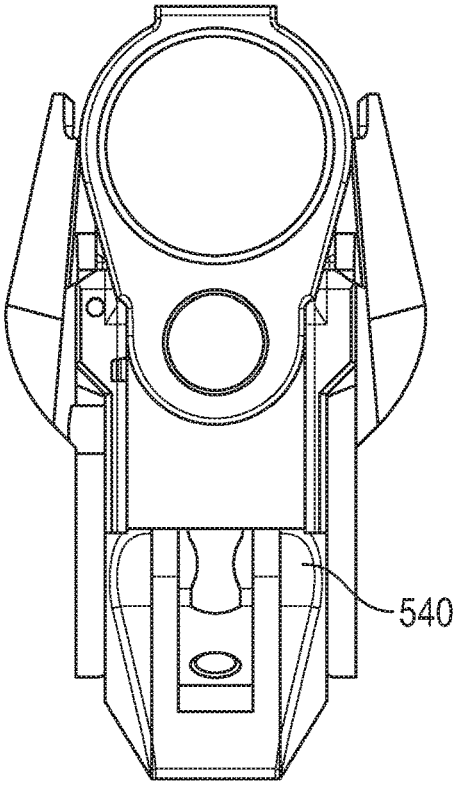
FIG. 40 is a rear view of the lower forend of FIG. 35.
Figure 41:
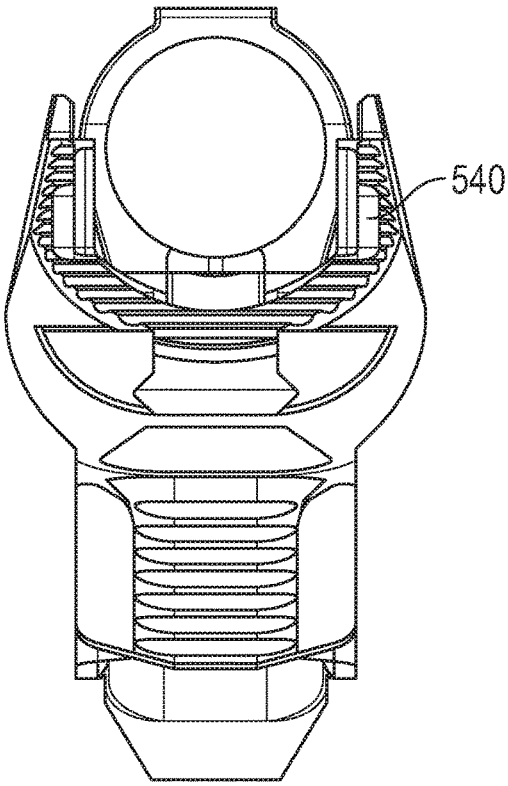
FIG. 41 is a front view of the lower forend of FIG. 35.
Figure 42:
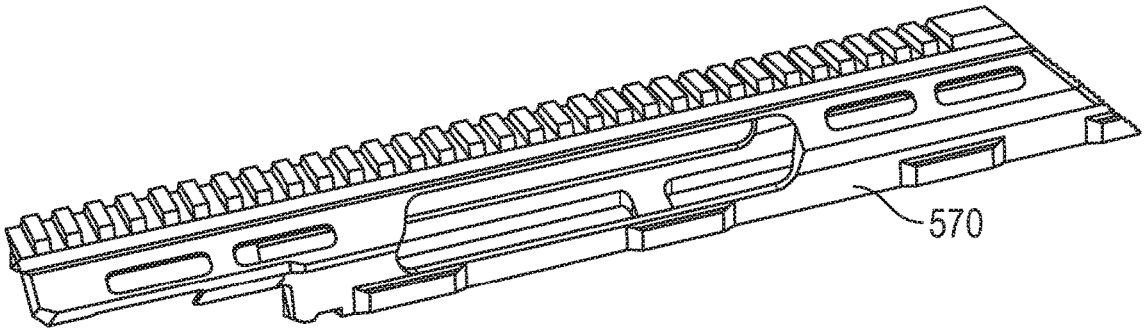
FIG. 42 is a perspective view of an upper forend of the firearm of FIG. 31.
Figure 43:
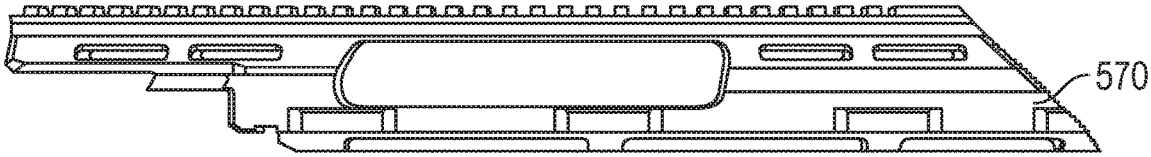
FIG. 43 is a right side view of the upper forend of FIG. 42.
Figure 44:
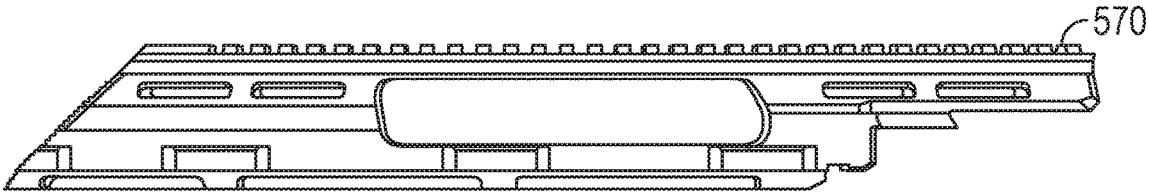
FIG. 44 is a left side view of the upper forend of FIG. 42.
Figure 45:
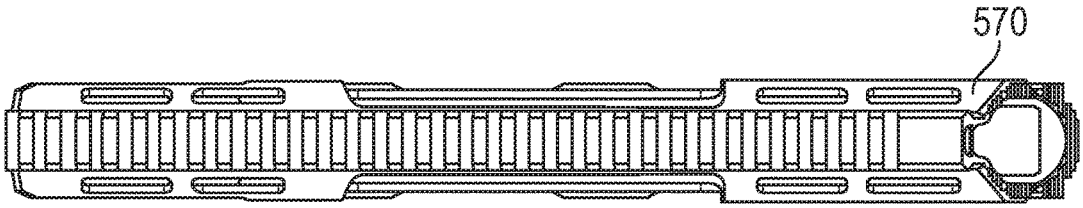
FIG. 45 is a top view of the upper forend of FIG. 42.
Figure 46:
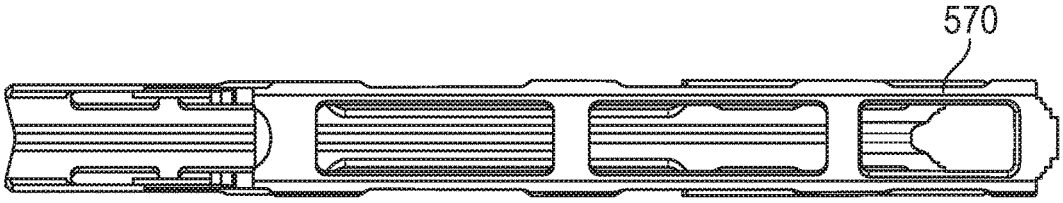
FIG. 46 is a bottom view of the upper forend of FIG. 42.
Figure 47:
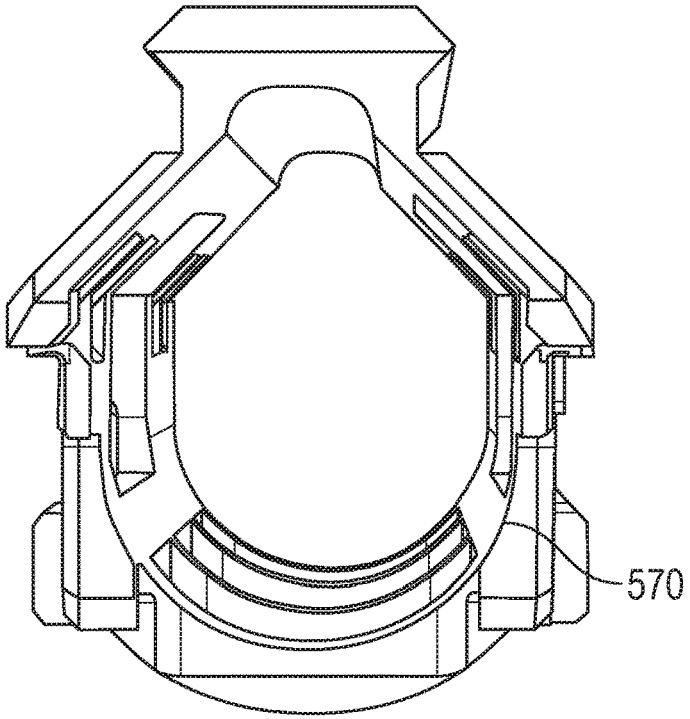
FIG. 47 is a rear view of the upper forend of FIG. 42.
Figure 48:
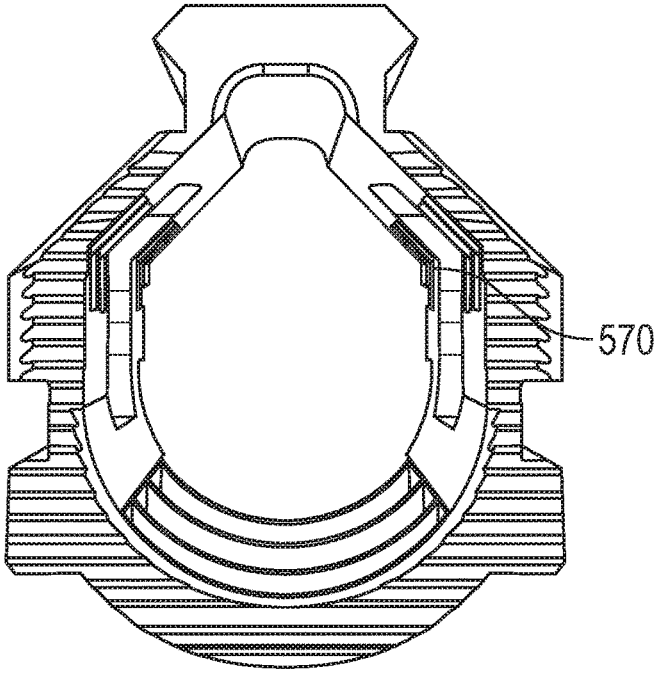
FIG. 48 is a front view of the upper forend of FIG. 42.
Figure 49:
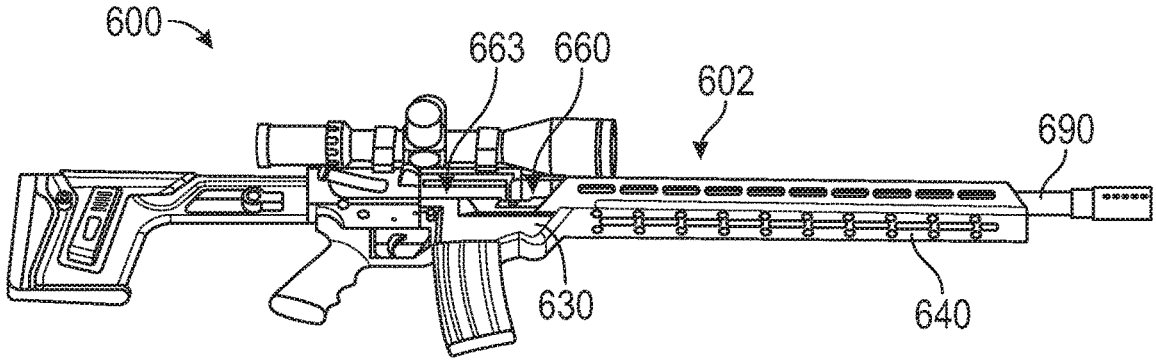
FIG. 49 is a perspective view of a firearm provided in accordance with the present disclosure.
Figure 50:
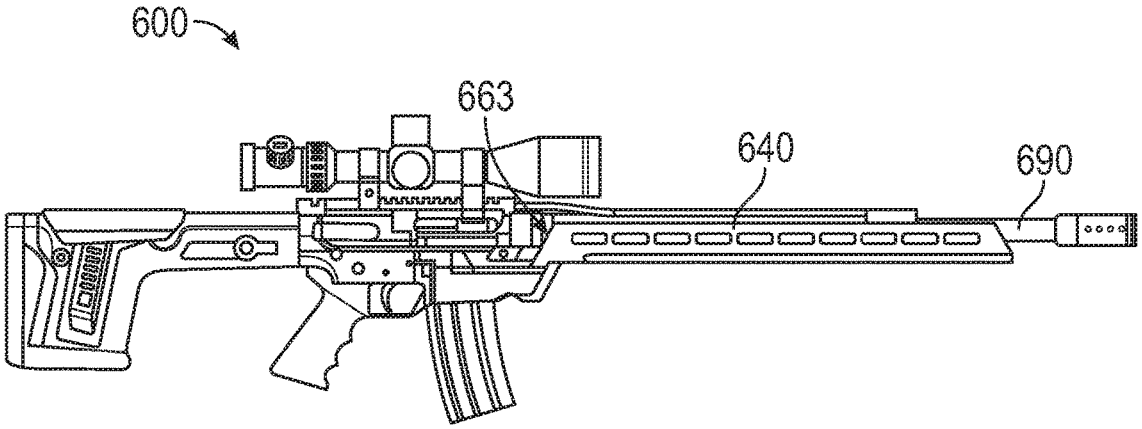
FIG. 50 is a right side view of the firearm of FIG. 49.
Figure 51:
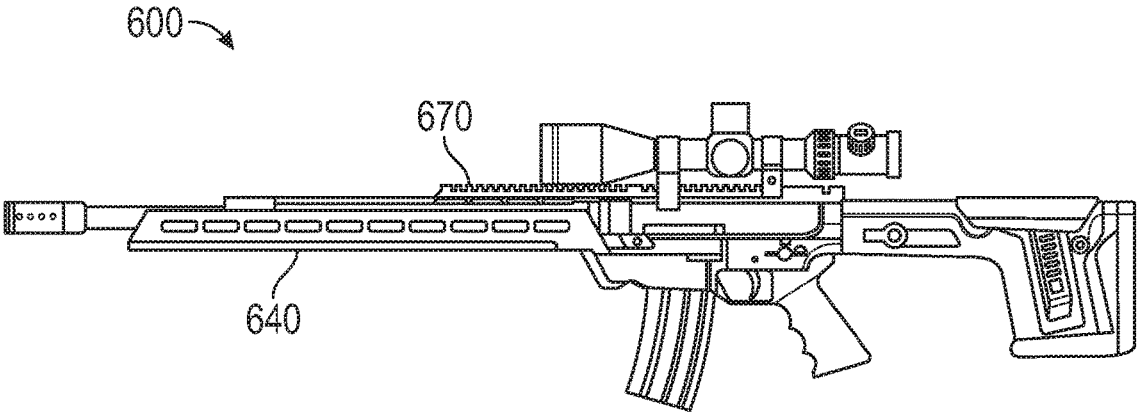
FIG. 51 is a left side view of the firearm of FIG. 49.
Figure 52:
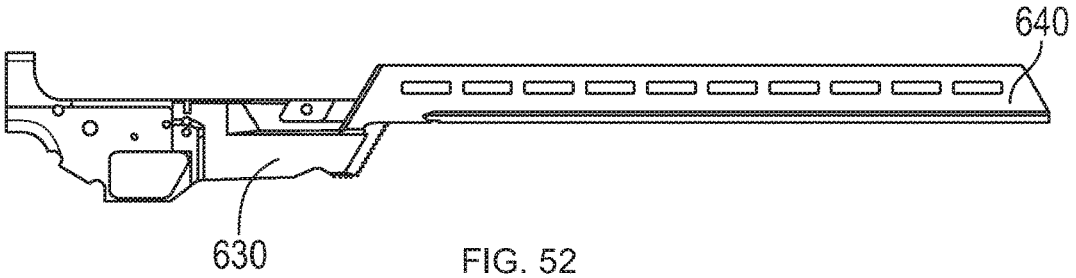
FIG. 52 is a right side view of a lower forend of the firearm of FIG. 49.
Figure 53:
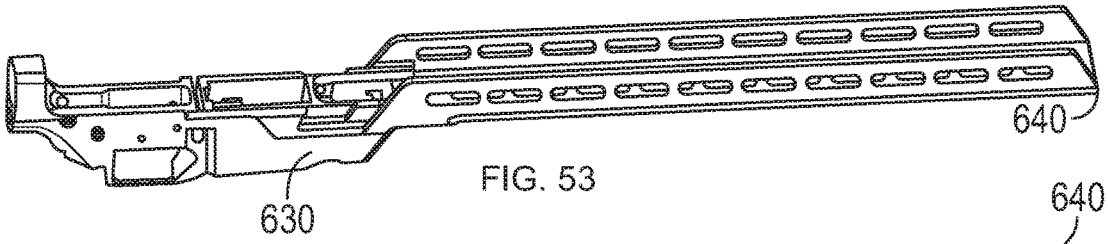
FIG. 53 is a perspective view of the lower forend of FIG. 52.
Figure 54:
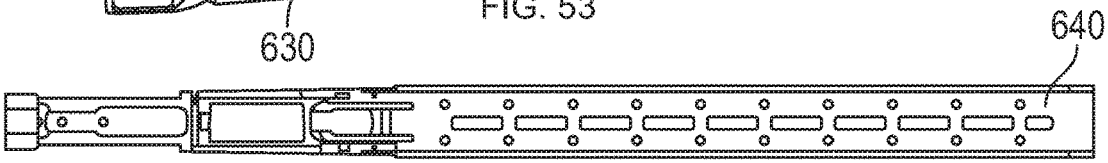
FIG. 54 is a bottom view of the lower forend of FIG. 52.
Figure 55:
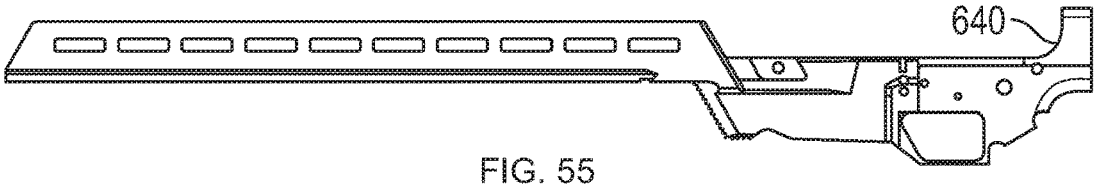
FIG. 55 is a left side view of the lower forend of FIG. 52.
Figure 56:
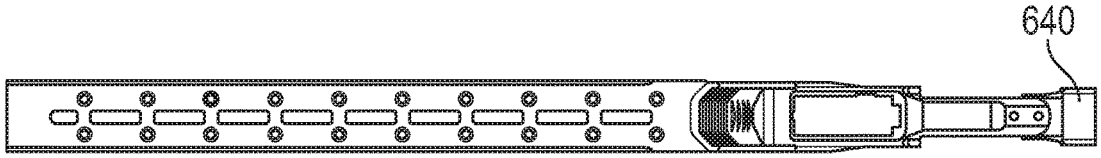
FIG. 56 is a top view of the lower forend of FIG. 52.
Figure 57:
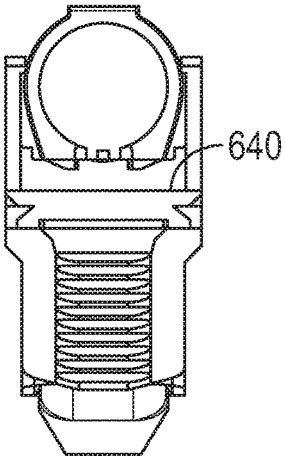
FIG. 57 is a front view of the lower forend of FIG. 52.
Figure 58:
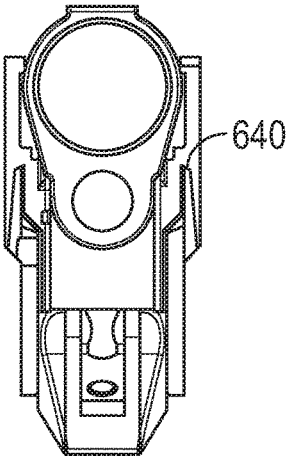
FIG. 58 is a rear view of the lower forend of FIG. 52.
Figure 59:
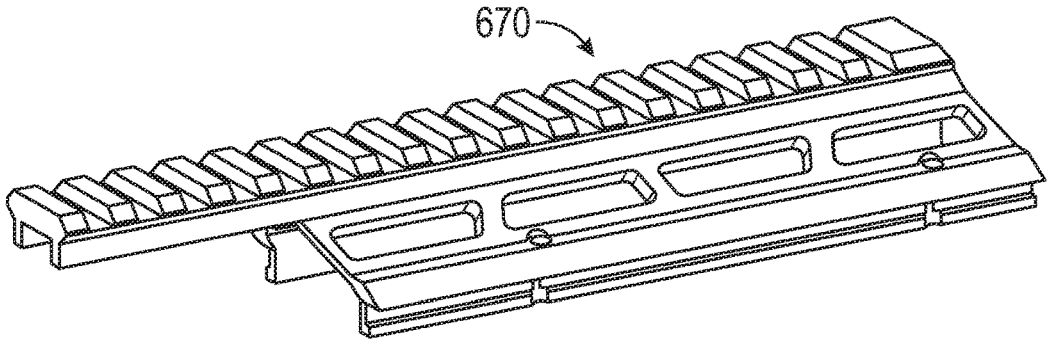
FIG. 59 is a perspective view of an upper forend of the firearm of FIG. 49.
Figure 60:
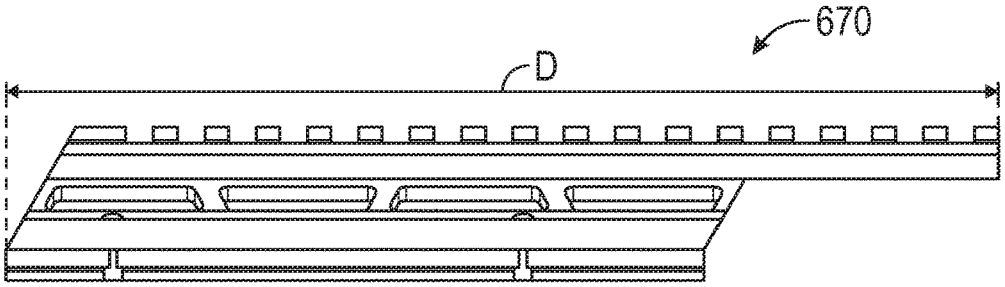
FIG. 60 is a left side view of the upper forend of FIG. 59.
Figure 61:
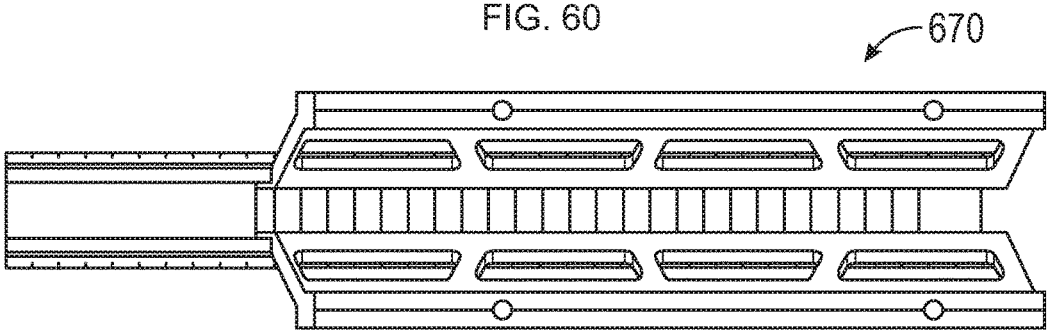
FIG. 61 is a bottom view of the upper forend of FIG. 59.
Figure 62:
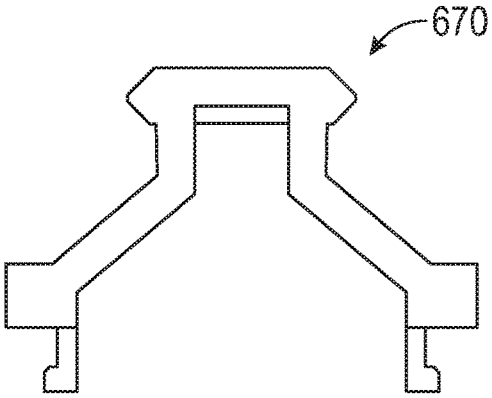
FIG. 62 is a rear view of the upper forend of FIG. 59.
Figure 63:
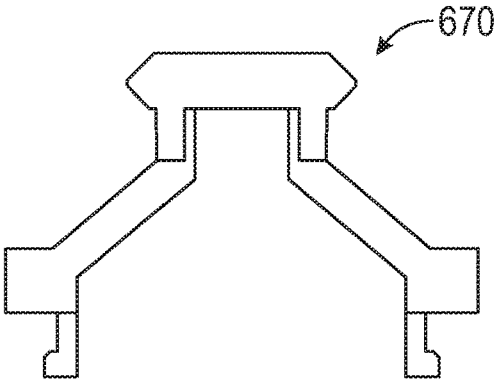
FIG. 63 is a front view of the upper forend of FIG. 59.
Figure 64:
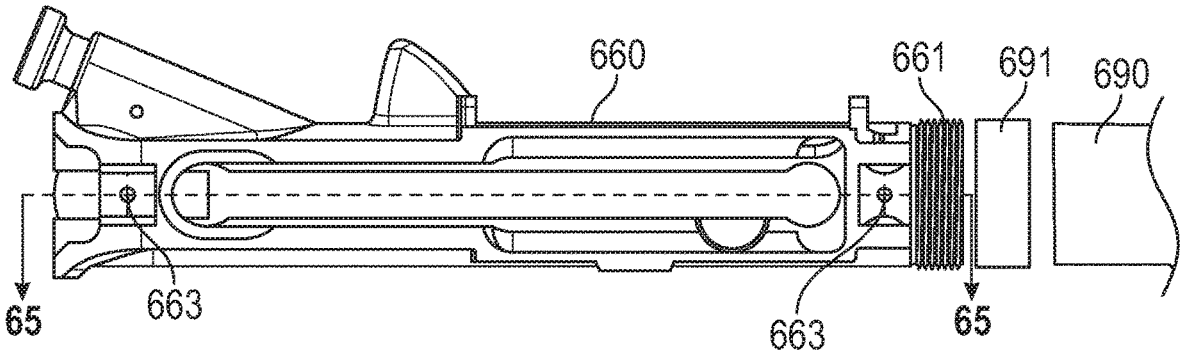
FIG. 64 is a bottom view of the upper receiver, the barrel nut, and a portion of the barrel, as shown in FIG. 49.
Figure 65:
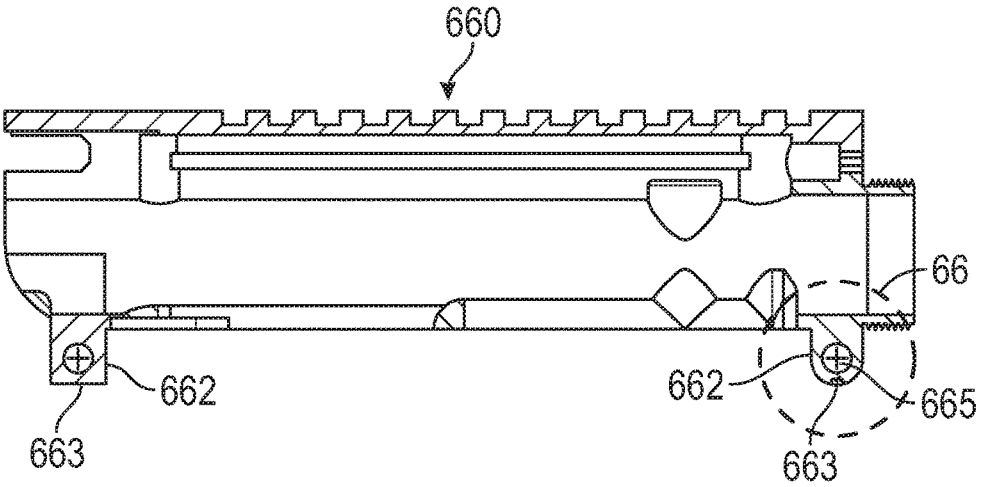
FIG. 65 is a side cross-sectional view of the upper receiver of FIG. 64.
Figure 66:
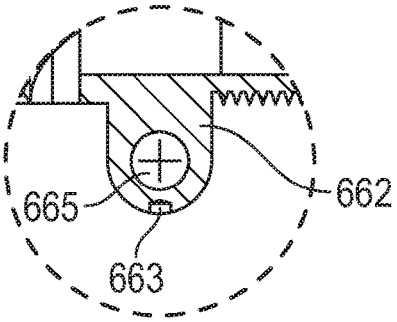
FIG. 66 is an enlarged view of the area of detail indicated by "66" in FIG. 65.

Firearm 500 includes a chassis 502 and a barrel 590 supported in the chassis 502. The chassis 502 includes an upper forend 570 slidably connected to a lower forend 540. As shown in FIG. 31A, the upper forend 570 is configured to operably slide into the lower forend 540. Further, as seen in FIGS. 32-34, the firearm 500 includes a fastening assembly 581 configured to enable connection and disconnection between the upper forend 570 and the lower forend 540.

The fastening assembly 581 includes a dowel pin 505 slidably supported in a proximal end of the lower forend 540, a connector piece 506 fixed in a proximal end of the upper forend 540, and a biasing member, such as, for example, a coil spring 507 disposed about the pin 505. The pin 505 has an annular flange 509 extending radially outward from a bottom end thereof. The flange 509 protrudes from a bottom surface of the lower forend 540 and is configured to be grasped by a user. The coil spring 507 is disposed about the pin 505 and supported at one end by the flange 509. The coil spring 507 resiliently biases the pin 505 inwardly (e.g., towards the upper forend 570) to position an upper end 511 of the pin 505 in an opening 513 defined in the connector piece 506 of the upper forend 570. In this way, upon assembling the upper forend 570 to the lower forend 540, the coil spring 507 drives the pin 505 into the opening 513 to axial fix the upper forend 570 to the lower forend 540. To release the upper forend 570 from the lower forend 540, a user may grasp and pull the pin against the resilient bias of the coil spring 507 to disengage the pin 505 from the opening 513, thereby allowing for sliding disengagement of the upper forend 570 from the lower forend 540. As such, the dowel pin 505 may be configured as a quick release element that allows for a manual disengagement of the forend 570 from the forend 540 without requiring a tool.

In other aspects, the fastening assembly 581 may be alternately configured as, e.g., a screw and a threaded hole, such as the one shown in FIG. 11. Additionally, although shown and described with reference to the pull knob/pin 505 connected to the lower forend 540 and configured to operably engage the connector piece 506 connected to the upper forend 570, it is understood that alternatively the pull knob 505 may be connected to the upper forend 570 and the connector piece 506 connected to the lower forend 540.

In embodiments, the firearm 500 may be configured in such a way that selected elements, e.g., the barrel 590, a gas system 591, and/or a barrel nut 592 (FIG. 32), do not contact the lower forend 540 and/or the upper forend 570. Thus, a force applied to any of the forends 540 or 570 may not exert a substantial force to enable a deflection of the barrel 590, e.g., the force of a weight (e.g., weight 401) connected to the lower end 540 may not displace to barrel 590 or ultimately affect the accuracy of firearm 500. In another example, the firearm 500 can be configured to connect to a stand or support 592 (e.g., a bipod), where the stand or support 592 provides zero to minimum stress to the barrel 590. Specifically, when the bipod 592 is connected to the lower forend 540 and disposed on a surface, the upward force from the bipod 592 is distributed and canceled by the lower forend 540 (and the upper forend 570, when the upper forend 570 is connected to the lower forend 540), which ultimately may increase accuracy and proper alignment of a receiver set having a positive lock up. Additional advantages may include the alignment of barrel 590 being true and accurate.

With reference to FIGS. 49-63, an alternative embodiment of a firearm 600 is provided, similar to firearms 400, 500. For reasons of brevity, only selected differences between firearm 600 and firearms 400, 500 may be detailed below.

The firearm 600 includes a chassis 602 and a barrel 690 supported in and by the chassis 602. The chassis 602 has a lower receiver 630, a lower forend 640 extending distally from and formed with the lower receiver 630, and an upper forend 670 configured to slidably connect to the lower forend 640. Each of the upper and lower forends 640, 670 are elongated and extend distally from the lower receiver 630. The upper forend 670 has a substantially V-shaped cross-section and is shorter in length when compared to the lower receiver 630.

Figure 69:
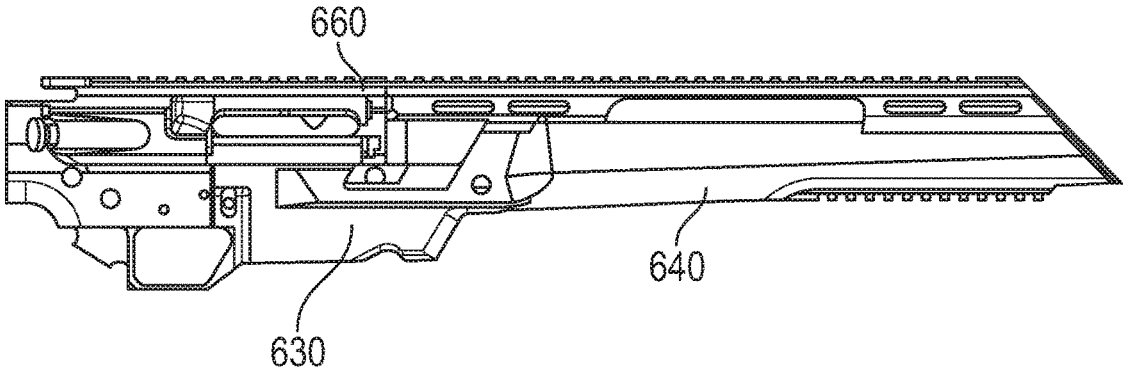
FIG. 69 is a side view illustrating the upper carrier of FIG. 64 connected to the lower receiver of FIG. 68.
Figure 70:
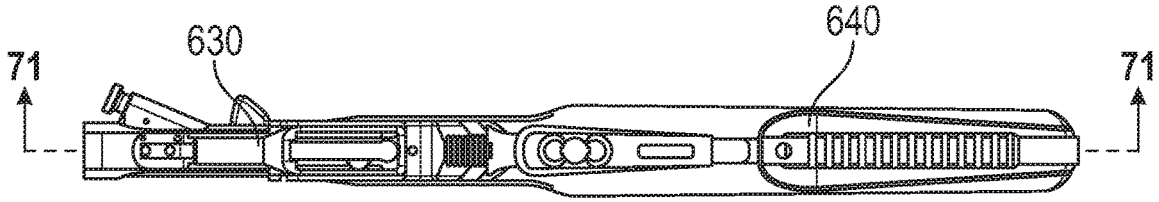
FIG. 70 is a bottom view of the chassis shown in FIG. 69.
Figure 71:
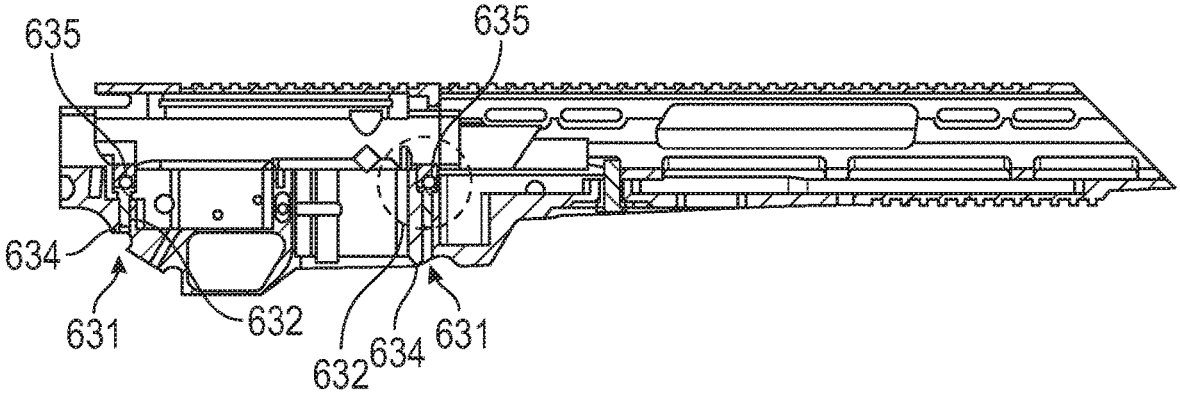
FIG. 71 is cross-sectional view, taken along line A-A in FIG. 70, illustrating the upper carrier and lower receiver assembled to one another via the two fasteners.

With particular reference to FIGS. 64-71, the upper receiver 660 includes a threaded portion 661 configured to operably connect to the barrel 690 via barrel nut 691. The barrel nut 691 secures barrel 690 to the upper receiver 660. As mentioned above, the barrel nut 691 is free floating. As shown in FIG. 69, the lower receiver 630 and the lower forend 640 are monolithically formed.

Figure 67:
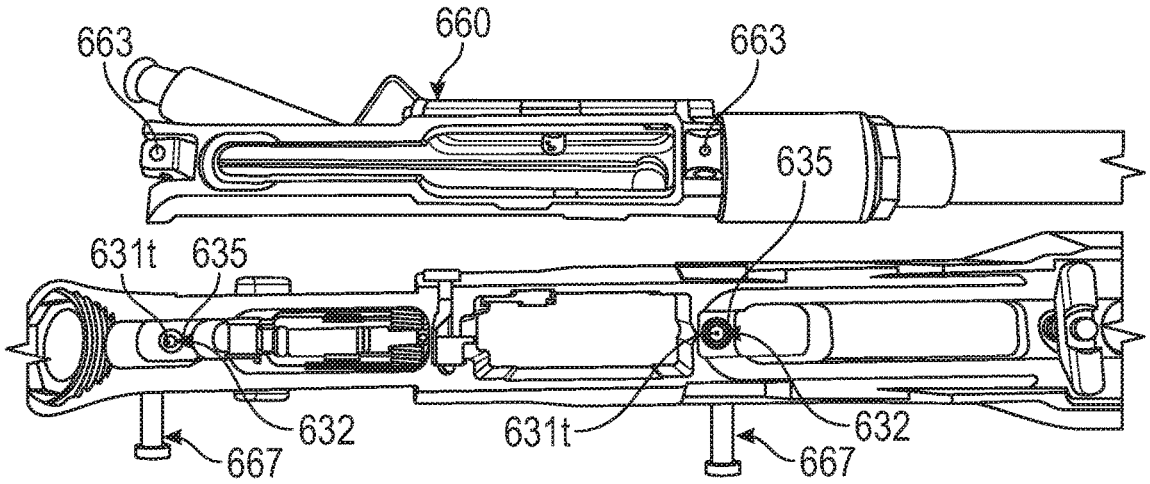
FIG. 67 is a plan view, with parts separated, of a bottom of the lower receiver of FIG. 63 and a top of the upper receiver of FIG. 64
Figure 68:
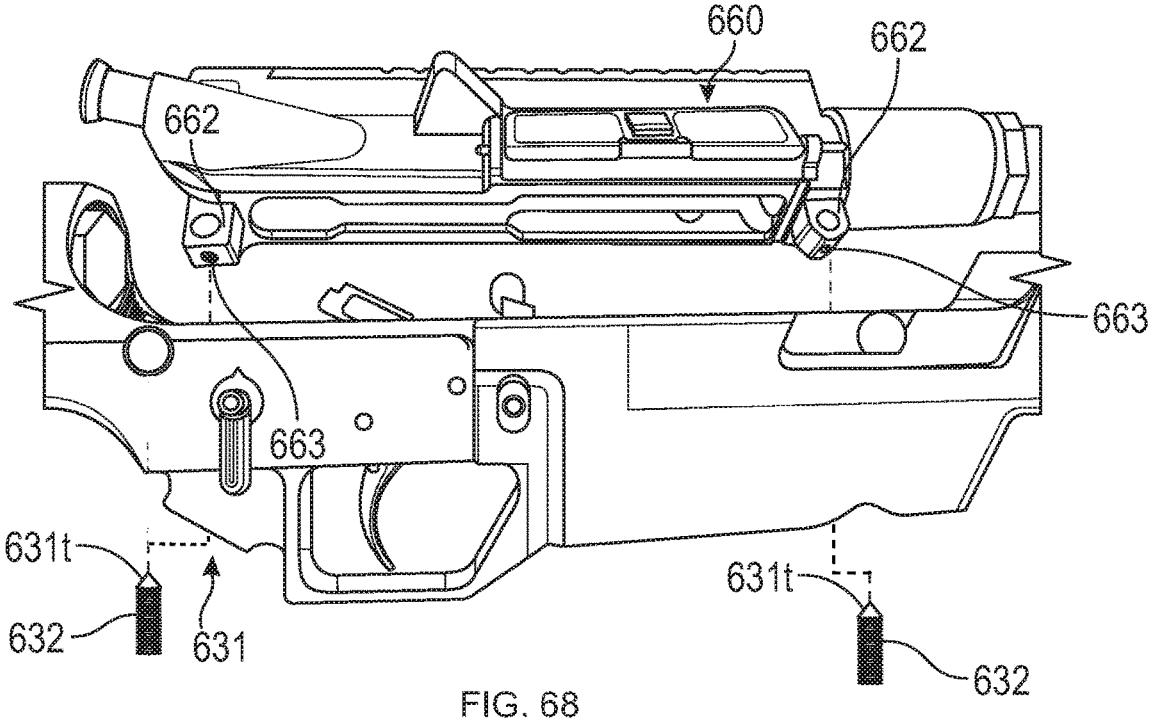
FIG. 68 is a side view of the upper carrier of FIG. 64 being assembled to the lower receiver of FIG. 67.

The upper receiver 660 is configured to detachably couple to the lower receiver 630 via a pair of proximal and distal tabs 662 that extend downwardly from a bottom of upper receiver 660. Each tab 662 defines vertically-extending indexing holes or pockets 663 configured for receipt of a corresponding fastener 632, and horizontally-extending holes 665 (FIGS. 65-66) configured for receipt of a corresponding dowel 667 (FIG. 67). In aspects, the pockets 663 may extend perpendicularly relative to the holes 665. It is contemplated that the pockets 663 only extend partially through the tabs 662 without extending into the holes 665.

Lower receiver 630 includes a pair of proximal and distal through holes 631 (FIG. 71) configured to align with the corresponding pair of proximal and distal alignment pockets 663 of upper receiver 660 upon assembling the upper receiver 660 to the lower receiver 630. Each hole 631 is configured to receive the fastener 632 (e.g., a set screw) and defines a lower opening 634 and an upper opening 635. In aspects, lower opening 634 may define a larger diameter than the diameter of the upper opening 635.

The fasteners 632 have a tip 631*t* having a conical shape configured for passage through the upper opening 635 of hole 631. In aspects, the tips 631*t* may assume any suitable shape and size configured for receipt in the corresponding alignment pockets 663. The tips 631*t* of the fasteners 631 are configured to engage the alignment pockets 663 and exert a vertically-oriented force on the upper receiver 660 to ultimately aid with setting an accurate linear alignment between the upper receiver 660 and the lower receiver 630.

During assembly, with the upper receiver 660 coupled to the lower receiver 630, the dowels 667 may be inserted into horizontal holes in the lower receiver 630 and the corresponding holes 665 in the upper receiver 660 to fix the upper receiver 660 to the lower receiver 630. The fasteners 631 are then screwed or otherwise inserted upwardly through the holes 631 in the lower receiver 630 and into the alignment pockets 663 of the upper receiver 660. The tips 631*t* of the fasteners 632 engage the pockets 663 of the upper receiver 660, thereby exerting an upwardly-oriented force on the upper receiver 660 relative to the lower receiver 630 to increase the frictional engagement between the dowel 667, the lower receiver 630, and the upper receiver 660. This may ultimately aid to eliminate any movement of the upper receiver 660 with respect to the lower receiver 630.

The firearms or portions thereof, e.g., firearms 200-600 detailed above, e.g., the chassis 220, 320, 402, 502, 602 may be used with a variety of firearms including, but not limited to, bolt action firearms, shotguns, semi-automatic firearms, pistols, or fully automatic firearms. Specifically, the modular rifle system may be designed for AR15/M4/M16 and AR10/M110 semiautomatic rifle uppers—inclusive of clone variants and upper receivers that use parts in common with the rifle uppers.

It is envisioned that the firearm system of the present disclosure is capable of printing, on average, about 0.6- to about 0.7-MOA groups at over 100 yards, with the best groups forming up at just over 0.3 MOA when firing commercially produced Federal match-grade ammunition. With an 18" Satern heavy-profile barrel installed, it is envisioned that the platform of the present disclosure is able to produce sub-MOA accuracy out to about 1062 yards.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A firearm chassis, comprising:

a lower receiver defining a trigger well configured to receive an action;

a lower forend monolithically formed with the lower receiver and extending distally from the lower receiver; and an upper forend configured to slidably connect to the lower forend in a direction parallel to the lower forend, the lower forend defining a channel along a length thereof configured to receive a barrel, wherein the lower receiver is configured to support at least a majority of a weight of the barrel.

2. The firearm chassis according to claim 1, wherein the lower receiver is configured to support an entirety of the weight of the barrel.

3. The firearm chassis according to claim 1, wherein the lower forend and the upper forend are dimensioned to encapsulate the barrel and be spaced from the barrel along an entire length of the barrel.

4. The firearm chassis according to claim 2, wherein the lower receiver supports the barrel thereon at a location proximal of a barrel nut of the barrel.

5. The firearm chassis according to claim 1, wherein the lower forend has a U-shaped transverse cross-sectional configuration.

6. The firearm chassis according to claim 1, further comprising at least one weight disposed within the lower forend, wherein the weight is configured to move between at least two different locations along a length of the lower forend to adjust a center of mass of the chassis.

7. The firearm chassis according to claim 1, further comprising a fastening assembly configured to secure the lower forend and the upper forend to each other.

8. The firearm chassis according to claim 7, wherein the fastening assembly includes a pin movably connected to the lower forend, wherein the pin is configured to engage the upper forend to selectively fix the upper forend to the lower forend.

9. The firearm chassis according to claim 8, further comprising a biasing member configured to resiliently bias the pin into engagement with an opening defined in the upper forend.

10. The firearm chassis according to claim 1, wherein the lower receiver defines a recess in a bottom surface thereof configured to receive a finger of a user, the recess being disposed distally of the magazine well.

11. The firearm chassis according to claim 1, wherein the lower receiver includes a stock mount extending upwardly therefrom, the stock mount defining an opening that extends in a direction parallel with a longitudinal axis defined by the lower forend.

12. A firearm system comprising:

a chassis including:

an elongated lower receiver defining a trigger well and a pair of vertically-oriented holes; and an elongated lower forend extending distally from the lower receiver, the lower forend defining a longitudinally-extending channel;

an upper receiver configured to couple to the lower receiver and defining a pair of vertically-oriented holes; and first and second fasteners configured for receipt in the corresponding vertically-oriented holes of the lower receiver and the upper receiver to exert a vertically-oriented force on the upper receiver and selectively secure the upper receiver to the lower receiver.

13. The firearm system according to claim 12, wherein the lower forend and the lower receiver are monolithically formed.

14. The firearm system according to claim 12, further comprising an elongated upper forend configured to detachably connect to the lower forend, wherein the upper forend and the lower forend cooperatively define an enclosed, elongated channel dimensioned for receipt of a barrel.

15. The firearm system according to claim 14, wherein the lower forend and the upper forend are configured to be spaced from the barrel along an entire length of the barrel.

16. The firearm system according to claim 15, wherein the lower receiver supports the barrel thereon at a location proximal of a barrel nut of the barrel, such that at least a majority of a weight of the barrel is supported by the lower receiver.

17. The firearm system according to claim 12, further comprising first and second dowels, wherein the upper receiver further defines a pair of horizontally-oriented holes in vertical registration with the pair of vertically-oriented holes of the upper receiver, the pair of horizontally-oriented holes configured for receipt of the corresponding first and second dowels.

* * * * *